US010513022B2

(12) United States Patent
Machida et al.

(10) Patent No.: US 10,513,022 B2
(45) Date of Patent: Dec. 24, 2019

(54) STRIKING DEVICE

(71) Applicant: MAKITA CORPORATION, Anjo-shi, Aichi (JP)

(72) Inventors: Yoshitaka Machida, Anjo (JP); Kiyonobu Yoshikane, Anjo (JP)

(73) Assignee: MAKITA CORPORATION, Anjo (JP)

( * ) Notice: Subject to any disclaimer, the term of this patent is extended or adjusted under 35 U.S.C. 154(b) by 273 days.

(21) Appl. No.: 15/526,450

(22) PCT Filed: Nov. 11, 2015

(86) PCT No.: PCT/JP2015/081796
§ 371 (c)(1),
(2) Date: May 12, 2017

(87) PCT Pub. No.: WO2016/076377
PCT Pub. Date: May 19, 2016

(65) Prior Publication Data

US 2017/0320206 A1 Nov. 9, 2017

(30) Foreign Application Priority Data

Nov. 12, 2014 (JP) ..... 2014-229930
Nov. 12, 2014 (JP) ..... 2014-229931

(51) Int. Cl.
*B25D 17/24* (2006.01)
*B25D 11/06* (2006.01)
(Continued)

(52) U.S. Cl.
CPC ..... *B25D 17/24* (2013.01); *B25D 11/00* (2013.01); *B25D 11/062* (2013.01); *B25D 17/04* (2013.01);
(Continued)

(58) Field of Classification Search
CPC .... B25D 17/043; B25D 17/245; B25D 17/24; B25D 16/006; B25D 2211/003;
(Continued)

(56) References Cited

U.S. PATENT DOCUMENTS 5,842,527 A * 12/1998 Arakawa ..... B25D 16/006 173/48
7,410,009 B2 * 8/2008 Hirayama ..... B25F 5/00 173/104
(Continued)

FOREIGN PATENT DOCUMENTS

CN 104066556 A 9/2014
DE 10332109 A1 2/2005
(Continued)

OTHER PUBLICATIONS

Feb. 27, 2018 Office Action issued in Japanese Patent Application No. 2014-229930.
(Continued)

*Primary Examiner* — Scott A Smith
(74) *Attorney, Agent, or Firm* — Oliff PLC

(57) ABSTRACT

An impact tool has a body and a striking mechanism that drives a tool accessory in a prescribed longitudinal direction. The body has a first body element on which the striking mechanism is provided, and a second body element. The first body element and the second body element are connected via a cushioning mechanism. A vibration reducing mechanism is provided on the first body element.

5 Claims, 14 Drawing Sheets

(51) Int. Cl.
*B25D 11/00* (2006.01)
*B25D 17/04* (2006.01)

(52) U.S. Cl.
CPC .. *B25D 2211/003* (2013.01); *B25D 2211/061* (2013.01); *B25D 2217/0076* (2013.01); *B25D 2217/0092* (2013.01); *B25D 2250/121* (2013.01)

(58) Field of Classification Search
CPC ..... B25D 2211/061; B25D 2217/0092; B25D 2217/0076; B25D 2250/121; B25D 11/062; B25D 2211/006; B25F 5/00; B25F 5/006; B25F 5/02
USPC ... 173/48, 104, 162.1, 162.2, 201, 210, 211, 173/216
See application file for complete search history.

(56) References Cited

U.S. PATENT DOCUMENTS

| | | | | |
|---|---|---|---|---|
| 8,167,054 | B2 * | 5/2012 | Nakashima | B25D 17/24 173/162.1 |
| 8,485,274 | B2 * | 7/2013 | Ikuta | B25D 11/125 173/162.1 |
| 9,724,814 | B2 * | 8/2017 | Yoshikane | B25D 11/062 |
| 2001/0037889 | A1 * | 11/2001 | Kristen | B25D 11/125 173/200 |
| 2003/0025281 | A1 | 2/2003 | Higasi et al. | |
| 2006/0086513 | A1 * | 4/2006 | Hashimoto | B25D 11/062 173/48 |
| 2007/0034396 | A1 | 2/2007 | Berger et al. | |
| 2009/0321101 | A1 * | 12/2009 | Furusawa | B25D 17/043 173/162.2 |
| 2010/0000751 | A1 * | 1/2010 | Aoki | B25D 17/24 173/114 |
| 2011/0011608 | A1 | 1/2011 | Saur | |
| 2011/0088922 | A1 * | 4/2011 | Hirayama | B25F 5/02 173/90 |
| 2015/0041170 | A1 | 2/2015 | Yoshikane et al. | |

FOREIGN PATENT DOCUMENTS

| | | | |
|---|---|---|---|
| DE | 202012012149 | U1 | 2/2013 |
| EP | 1151827 | A1 | 11/2001 |
| GB | 2129733 | A | 5/1984 |
| JP | 2006-21261 | A | 1/2006 |
| JP | 2008-238334 | A | 10/2008 |
| JP | 2009-509790 | A | 3/2009 |
| JP | 2011-245580 | A | 12/2011 |
| WO | 2007/039356 | A1 | 4/2007 |

OTHER PUBLICATIONS

Jun. 8, 2018 Extended European Search Report issued in European Patent Application No. 15859060.4.
Apr. 25, 2018 Office Action issued in Japanese Patent Application No. 2014-229931.
Dec. 28, 2015 International Search Report issued in International Patent Application No. PCT/JP2015/081796.
Jan. 28, 2019 Office Action issued in Chinese Patent Application No. 201580061096.5.
May 16, 2017 International Preliminary Report on Patentability issued in International Application No. PCT/JP2015/081796.
Apr. 23, 2019 Office Action issued in Russian Patent Application No. 2017119226.
Sep. 23, 2019 Office Action issued in Chinese Patent Application No. 201580061096.5.

* cited by examiner

STRIKING DEVICE

TECHNICAL FIELD

The present invention relates to an impact tool for performing an operation on a workpiece.

BACKGROUND ART

WO2007/039356 discloses an electric machine tool in which a housing shell half with a handgrip to be held by user and a housing shell half having a striking mechanism housed therein are separately arranged from each other. The two housing shell halves form an outer shell of the electric machine tool and are connected to each other via a compression spring, so that the shell halves can move with respect to each other.

PRIOR ART DOCUMENT

Patent Document

Patent Document 1: WO2007/039356

SUMMARY OF THE INVENTION

Problems to be Solved by the Invention

The above-described electric machine tool is capable of absorbing vibration of the housing having the striking mechanism housed therein, so that transmission of vibration to a user's hand is reduced. However, the striking mechanism itself is not vibration-proof, so that the striking output may be adversely affected by vibration caused from the striking mechanism. Therefore, it is desired to provide a vibration-proofing structure to reduce or minimize transmission of vibration from the striking mechanism to the user and to reduce influence on the striking output.

Accordingly, it is an object of the present invention to provide a technique for reducing or minimizing transmission of vibration caused by hammering operation to a user while enhancing striking output efficiency.

Invention for Solving the Problem

In order to solve the above-described problem, according to the present invention, an impact tool is configured to perform a hammering operation on a workpiece by driving a tool accessory in a prescribed longitudinal direction. The impact tool has a body and a striking mechanism that drives the tool accessory in the longitudinal direction. The longitudinal direction in which the tool accessory is driven coincides with an axial direction of the tool accessory when the tool accessory is attached to the impact tool. The striking mechanism does not include all mechanisms required for driving the tool accessory in the longitudinal direction, but it is sufficient to include only some of the mechanisms.

The body has a first body element and a second body element. The striking mechanism is provided on the first body element, and the first body element is configured to be movable with respect to the second body element. In this case, for example, a driving motor and a handgrip to be held by a user may be provided on the second body element.

Further, the first body element and the second body element are connected via a cushioning mechanism, and a vibration reducing mechanism is provided on the first body element.

In the impact tool according to this aspect of the present invention, vibration caused by the striking mechanism is efficiently reduced by the first body element. Therefore, adverse effect of vibration caused by impact driving on the striking force is reduced.

Further, with the structure in which the first body element having the striking mechanism mounted thereto and the second body element are connected via the cushioning mechanism, vibration caused by impact driving is not easily transmitted to the second body element. In this case, for example, in a structure in which a handgrip as described below is provided on the second body element, transmission of vibration to a user's hand is reduced.

According to a further aspect of the impact tool of the present invention, the vibration reducing mechanism may be a counter weight. In this case, the counter weight may include a weight part provided on the first body element.

According to a further aspect of the impact tool of the present invention, the vibration reducing mechanism may be a dynamic vibration reducer. In this case, the dynamic vibration reducer includes an elastic member having a first elastic member disposed on the first body element side and a second elastic member disposed on the second body element side, and a weight part disposed between the first elastic member and the second elastic member.

In the impact tool according to this aspect, vibration caused by impact driving is efficiently reduced by reciprocating movement of the weight part between the first elastic member and the second elastic member.

According to a further aspect of the impact tool of the present invention, the impact tool may have a driving motor that is provided on the second body element and drives the striking mechanism. In this case, transmission of vibration from the striking mechanism to the driving motor is reduced.

According to a further aspect of the impact tool of the present invention, the impact tool may have a handgrip designed to be held by a user and having an extending axis that extends in a direction crossing a central axis of the tool accessory extending in the longitudinal direction. An operation part such as a trigger may be arranged on the handgrip and operated by a user to energize the driving motor. In such a structure, the center of gravity of the weight part may be located on a plane defined by the central axis and the extending axis.

In the impact tool according to this aspect, the vibration reducing mechanism stably reduces vibration caused by driving of the striking mechanism.

Further, in the impact tool according to this aspect, the impact tool may be configured to have its center of gravity on the above-described central plane. In this case, the center of gravity of the impact tool and the center of gravity of the weight part are located on the same plane. Therefore, the user can hold the impact tool with stability, According to a further aspect of the impact tool of the present invention, the weight part may include a plurality of weight elements. Specifically, the number of the weight elements may be freely determined in consideration of requirements for the impact tool to be designed.

According to a further aspect of the impact tool of the present invention, the first body element and the second body element may be connected via a guide part. In this case, the weight part and the elastic member may be arranged coaxially with the guide part and configured to reciprocatingly slide with respect to the guide part.

In the impact tool according to this aspect, the weight part smoothly slides on the guide part, so that the vibration reducing effect of the vibration reducing mechanism is enhanced.

Further, in the impact tool according to this aspect, the extending direction of the guide part may be parallel to the longitudinal direction. In this case, the weight part reciprocates in the longitudinal direction, so that the vibration reducing mechanism can achieve more efficient vibration reduction.

Effect of the Invention

According to the present invention, an impact tool is provided that reduces or minimizes transmission of vibration caused by hammering operation to a user while enhancing striking output efficiency.

EMBODIMENTS FOR CARRYING OUT THE INVENTION

Summary of the Invention

Figure 1:
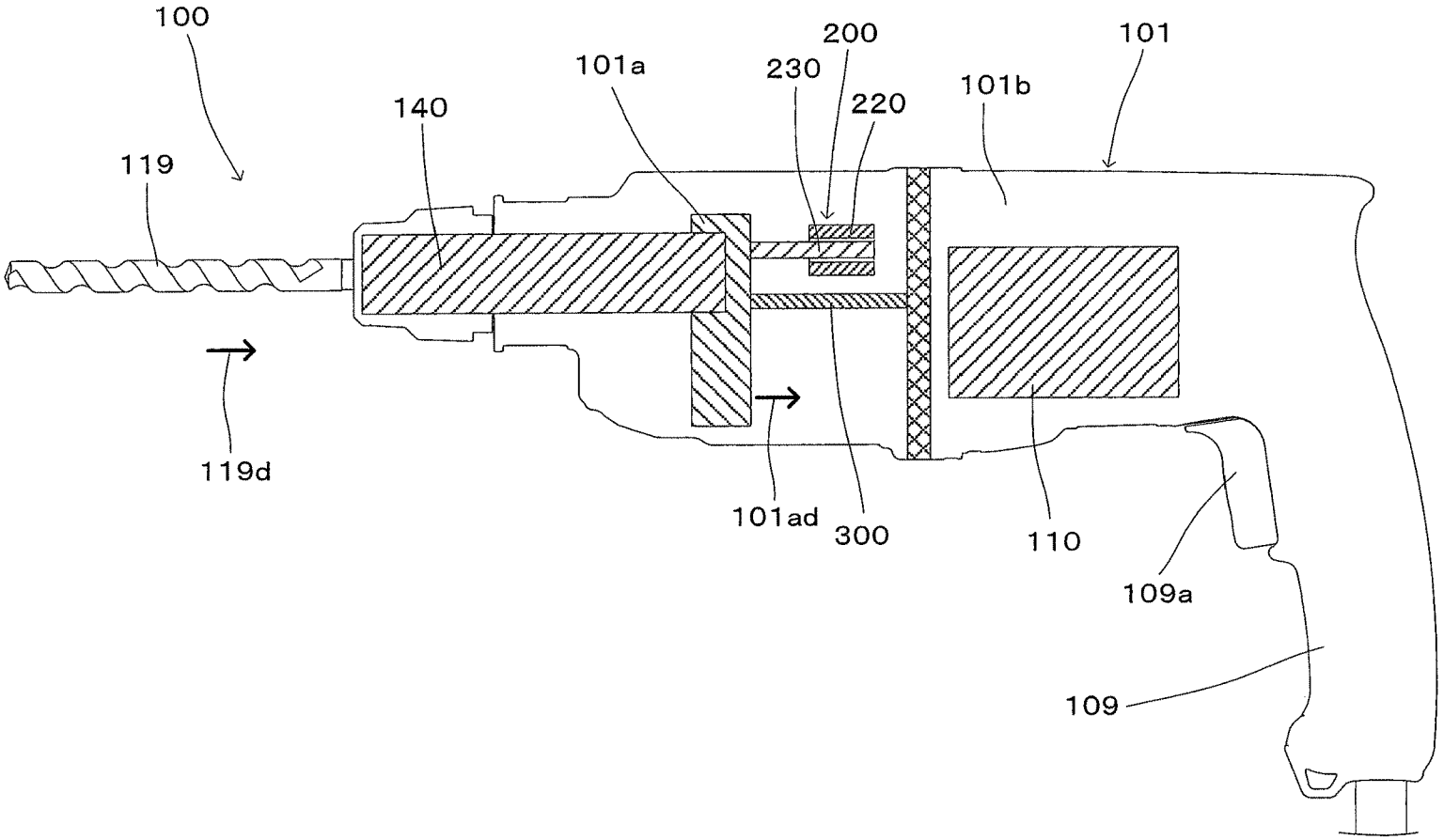
FIG. 1 is a schematic view for showing a summary of the present invention.

An impact tool according to the present invention is now summarized with reference to FIG. 1. The impact tool 100 is configured to perform a hammering operation on a workpiece by driving a tool accessory 119 in a prescribed longitudinal direction and has a body 101 to which the tool accessory 119 is removably attached, a striking mechanism 140 for linearly driving the tool accessory 119, an electric motor 110 for driving the striking mechanism 140, a handgrip 109 designed to be held by a user, and a trigger 109*a* which is operated by the user. The prescribed longitudinal direction in which the tool accessory 119 is driven coincides with an axial direction of the tool accessory 119 when the tool accessory 119 is attached to the impact tool 100. The striking mechanism 140 is provided to cause the tool accessory 119 to perform hammering motion based on the output of the electric motor 110. The striking mechanism 140 is not provided to include all mechanisms required for the hammering motion of the tool accessory 119, but it is only necessary for the striking mechanism 140 to include some of the mechanisms required for the hammering motion of the tool accessory 119.

The body 101 has a first body element 101*a* and a second body element 101*b*. The striking mechanism 140 is provided on the first body element 101*a*, and the first body element 101*a* is configured to be movable with respect to the second body element 101*b*. When the impact tool 100 is not pressed against a workpiece by a user (in a non-pressed state), the first body element 101*a* and the striking mechanism 140 are biased to the tip side (forward). When the user holds the handgrip 109 and presses the tip of the tool accessory 119 against the workpiece, the tool accessory 119 is moved in a direction of an arrow 119*d*. By movement of the tool accessory 119 in the direction of the arrow 119*d*, the first body element 101*a* and the striking mechanism 140 are moved in a direction of an arrow 101*a*d. The directions of the arrows 119*d*, 101*ad* are opposite to a direction toward the tip side (forward direction) and thus referred to as an opposite (rearward) direction. In this sense, the tool accessory 119, the striking mechanism 140 and the first body element 101*a* are integrated together and can move together with respect to the second body element 101*b*.

The first body element 101*a* is configured to be movable with respect to the second body element 101*b*. In other words, the first body element 101*a* and the second body element 101*b* can move with respect to each other. The second body element 101*b* refers to a prescribed region of the body 101 which can move with respect to the first body element 101*a*. In this case, for example, a part connected to the first body element 101*a* may form the second body element 101*b*. When the second body element 101*b* is configured as the prescribed region of the body 101, the electric motor 110 may be mounted to the second body element 101*b* and the handgrip 109 may be provided on the second body element 101*b*. In this sense, it can be said that the first body element 101*a* and the electric motor 110 can move with respect to each other, and that the first body element 101*a* and the handgrip 109 can move with respect to each other.

Further, the body 101 of the impact tool 100 may be configured, for example, such that a region having the electric motor 110 and a region having the handgrip 109 are separated from each other and a prescribed region of the body 101 having the electric motor 110 and a prescribed region of the body 101 having the handgrip 109 can move with respect to each other. In this case, the two prescribed regions of the body 101 may be connected via a vibration proofing mechanism such as a dynamic vibration reducer.

In this case, a plurality of such second body elements 101*b* which can move with respect to the first body element 101*a* may be provided, and the present invention also includes such configuration.

The first body element 101*a* and the second body element 101*b* are connected via a cushioning mechanism 300. The cushioning mechanism 300 may include an elastic element such as a coil spring and rubber. The cushioning mechanism 300 biases the first body element 101*a* forward.

A vibration reducing mechanism 200 is further provided on the first body element 101*a*. In FIG. 1, a counter weight is configured as the vibration reducing mechanism 200 by providing a weight part 220 on a longitudinally extending guide part 230 mounted to the first body element 101*a*. The vibration reducing mechanism 200 may also be a dynamic vibration reducer having the weight part 220 and an elastic member.

Each of the vibration reducing mechanism 200 and the cushioning mechanism 300 has an extending axis. The striking mechanism 140 has an extending axis extending in the axial direction of the tool accessory 119. It is preferred that the extending axis of the vibration reducing mechanism 200 is arranged closer to the extending axis of the striking mechanism 140 than to the extending axis of the cushioning mechanism 300. Further, it is preferred that the extending axis of the vibration reducing mechanism 200 extends in parallel to the extending axis of the striking mechanism 140. It is further preferred that the extending axes of the vibration reducing mechanism 200, the striking mechanism 140 and the cushioning mechanism 300 are parallel to each other.

In the impact tool 100 having such a structure, the vibration reducing mechanism 200 reduces vibration caused by driving of the striking mechanism 140. As a result, the striking mechanism 140 is driven with stability. Further, the vibration reduced by the vibration reducing mechanism 200 is transmitted to the second body element 101*b* via the cushioning mechanism 300. Therefore, transmission of vibration to the user is reduced. At this time, the electric motor 110, which is provided in the second body element 101*b*, is less adversely affected by the vibration.

First Embodiment

A first embodiment of the present invention is now explained with reference to FIGS. 2 to 9. Some parts which have substantially the same functions as those of the impact tool 100 described with reference to FIG. 1 are given like designations and numerals. Further, for the sake of convenience, the left side in FIGS. 2, 3, 4, 5, 7, 8 and 9 is taken as a front or tip side of the impact tool, while the right side is taken as a rear or rear end side of the impact tool. Further, the upper side in FIGS. 2, 3, 4 and 5 is taken as an upper side of the impact tool, while the lower side is taken as a lower side of the impact tool.

(Basic Structure Relating to the Outer Appearance)

Figure 2:
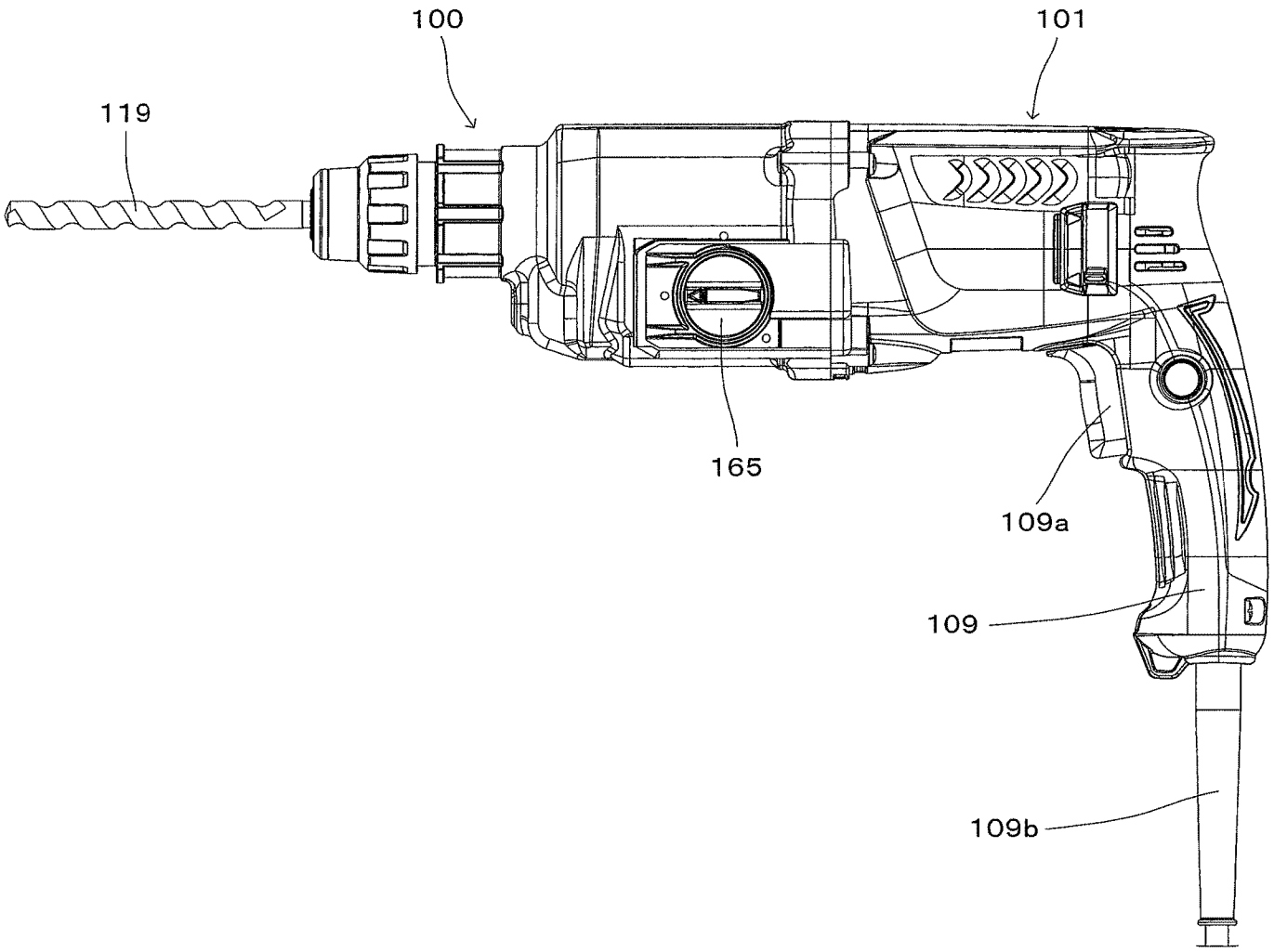
FIG. 2 is an external view of a hammer drill according to a first embodiment of the present invention.

Referring to an external view shown in FIG. 2, the basic structure of the impact tool 100 according to the first embodiment is explained. In this embodiment, a hand-held hammer drill 100 is described as a representative example of the impact tool according to the present invention. The hammer drill 100 is an example embodiment that corresponds to the "impact tool" according to the present invention.

As shown in FIG. 2, the hammer drill 100 is a hand-held impact tool having a handgrip 109 to be held by a user and configured to perform hammering motion for a hammering operation such as a chipping operation on a workpiece by driving the hammer bit 119 in the axial direction of the hammer bit 119 and to perform rotating motion for a drilling operation on a workpiece by rotationally driving the hammer bit 119 around its axis.

The axial direction in which the hammer drill 100 drives the hammer bit 119 defines the longitudinal direction of the hammer drill 100. The longitudinal direction coincides with the axial direction of the hammer bit 119 when the hammer bit 119 is attached to the hammer drill 100. The hammer bit 119 is attached to a front end region of a tool holder 159, which will be described below in further detail with reference to FIG. 3. Therefore, the hammer bit 119 protrudes from the front end of the tool holder 159. The hammer bit 119 is an example embodiment that corresponds to the "tool accessory" according to the present invention. A trigger 109*a* which is operated by the user is arranged on the front side of the handgrip 109, and a power cable 109*b* for supplying current to the hammer drill 100 is mounted to a lower end of the handgrip 119. The handgrip 109 is formed on a body housing 101 which forms an outer shell of the hammer drill 100. The body housing 101 is an example embodiment that corresponds to the "body" according to the present invention.

Figure 3:
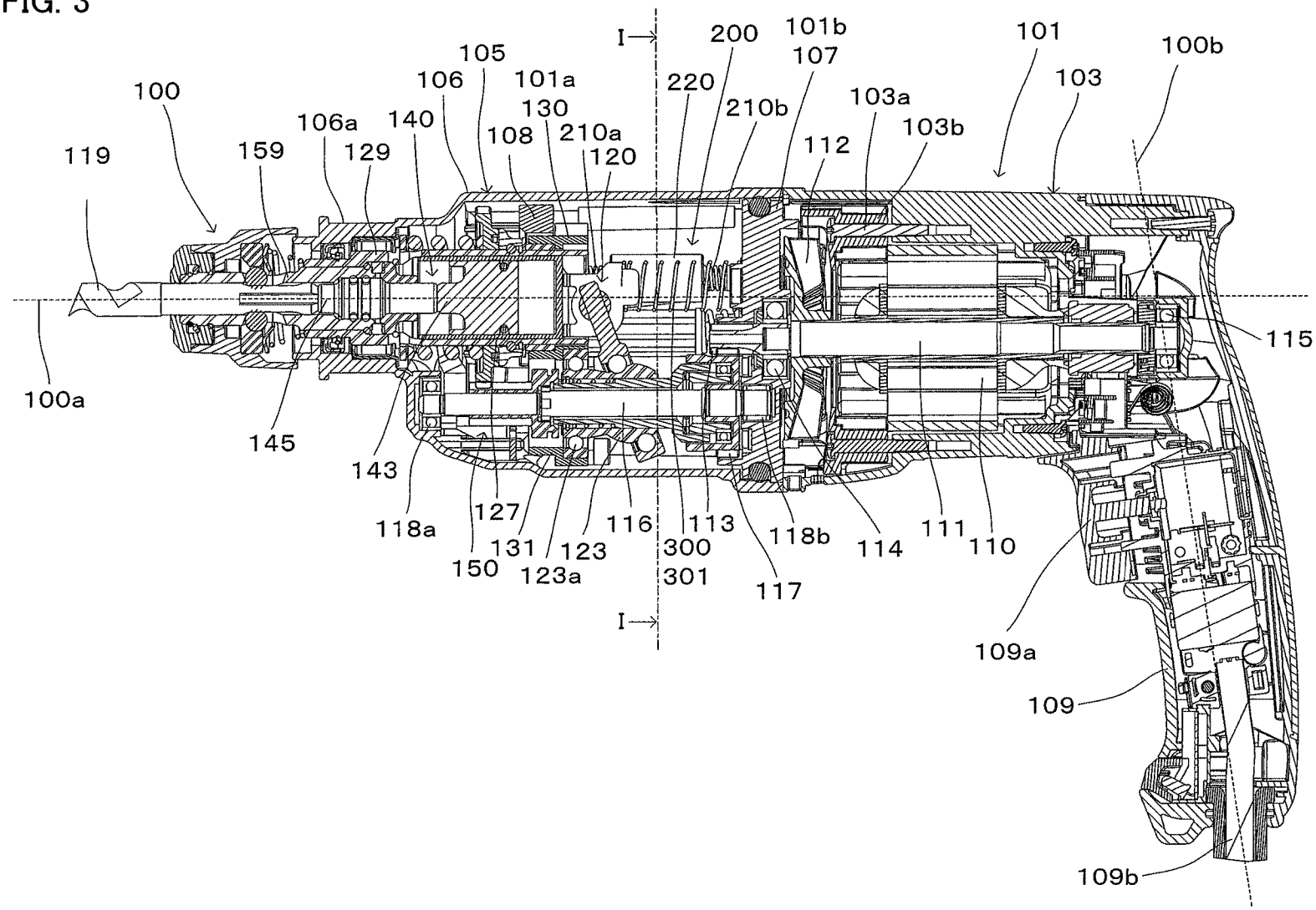
FIG. 3 is a sectional view of the hammer drill.

As shown in FIG. 3, the handgrip 109 has an extending axis 100*b* which extends in a direction crossing a central axis 100*a* of the hammer bit 119 extending in the longitudinal direction. The central axis 100*a* and the extending axis 100*b* define a central plane 100*c*. The center of gravity of the weight part 220 is located on the central plane 100*c* as described below with reference to FIG. 6.

The central axis 100*a*, the extending axis 100*b* and the central plane 100*c* are example embodiments that correspond to the "central axis", the "extending axis" and the "prescribed plane", respectively, according to the present invention.

The hammer drill 100 has prescribed drive modes, i.e. a hammer mode of causing the hammer bit 119 to perform hammering motion in the axial direction of the hammer bit 119, a drill mode of causing the hammer bit 119 to perform rotating motion around the axis of the hammer bit 119, and a hammer drill mode of causing the hammer bit 119 to perform hammering motion in the axial direction and rotating motion around the axis. The drive modes can be switched with a changeover dial 165. In the following description, for the convenience sake, a structure of biasing the hammer bit 109 toward a prescribed position and a structure of switching the drive mode with the changeover dial 165 may be omitted except for a structure pertaining to the present invention.

(Structure of the Body Housing)

As shown in FIG. 3, a cylindrical tool holder 159 is provided in a front end region of the body housing 101 so as to allow the hammer bit 119 to be removably attached to the body housing 101. The hammer bit 119 is inserted into a bit insertion hole of the tool holder 159 and held such that it is allowed to reciprocate in its axial direction and prevented from rotating around its axis with respect to the tool holder 159. Further, the axis of the tool holder 159 coincides with the axis of the hammer bit 119.

The body housing 101 mainly includes a motor housing 103 and a gear housing 105. The motor housing 103 is arranged in a rear region of the body housing 101, and the gear housing 105 is arranged in a front region of the body housing 101. Further, the handgrip 109 is arranged on the lower side of the motor housing 103. The motor housing 103 and the gear housing 105 are fixedly connected to each other by a fastening means such as screws so as not to move with respect to each other. Thus, the single body housing 101 is formed. Specifically, the motor housing 103 and the gear housing 105 are formed as separate housings in which respective internal mechanisms are mounted, and integrally connected together by the fastening means to form the single body housing 101.

(Structure of the Motor Housing) As shown in FIG. 3, the electric motor 110 is mounted in the motor housing 103.

Specifically, the electric motor 110 is mounted to the motor housing 103 via a baffle plate 103*b* by fastening means such as screws 103*a*. The electric motor 110 is housed in the motor housing 103 such that an extending axis of an output shaft 111 of the electric motor 110 extends in parallel to the axis of the hammer bit 119. The output shaft 111 protrudes forward through the baffle plate 103*b*, and a motor cooling fan 112 is mounted to a front end region of the output shaft 111 and rotates together with the output shaft 111. A pinion gear 113 is provided in front of the fan 112 on the output shaft 111. A front bearing 114 is provided between the pinion gear 113 and the fan 112, and a rear bearing 115 is provided on a rear end of the output shaft 111. With such a structure, the output shaft 111 is rotatably supported by the bearings 114, 115. Further, the front bearing 114 is held by a bearing support part 107 which forms part of the gear housing 105, and the rear bearing 115 is held by the motor housing 103. Therefore, the electric motor 110 is held such that the pinion gear 113 protrudes into the gear housing 105. Further, the pinion gear 113 is typically formed as a helical gear. The electric motor 110 is an example embodiment that corresponds to the "driving motor" according to the present invention.

The bearing support part 107 is fixed to the motor housing 103 and the gear housing 105, so that the bearing support part 107 cannot move with respect to the motor housing 103 and the gear housing 105.

A holding member 130 to which the striking mechanism 140 is mounted is movably connected to the bearing support part 107 as described below. The holding member 130 and the bearing support part 107 are example embodiments that correspond to the "first body element (first body element 101*a* according to FIG. 1)" and the "second body element (second body element 101*b* according to FIG. 1)", respectively, according to the present invention. As described above, the second body element 101*b* according to the present invention is configured to be movable with respect to the first body element 101*a*. Therefore, it can also be said that the motor housing 103 is an example embodiment that corresponds to the second body element 101*b*, and furthermore that the body housing 101 forming the outer shell of the hammer drill 100 is an example embodiment that corresponds to the second body element 101*b*.

(Structure of the Gear Housing)

As shown in FIG. 3, the gear housing 105 mainly includes a housing part 106, the bearing support part 107 and a guide support part 108. The gear housing 105 forms an outer shell of a front region of the hammer drill 100 (the body housing 101). A cylindrical barrel part 106*a* to which an auxiliary handgrip is attached is formed in a front end region of the housing part 106. The auxiliary handgrip is not shown for convenience sake.

The bearing support part 107 and the guide support part 108 are fixedly mounted to an inner peripheral surface of the housing part 106. The bearing support part 107 supports the bearing 114 for holding the output shaft 111 of the electric motor 110 and a bearing 118*b* for holding an intermediate shaft 116. The guide support part 108 is disposed substantially in a middle region of the gear housing 105 in the longitudinal direction of the hammer drill 100 and supports front end parts of a first guide shaft 170*a* and a second guide shaft 170*b* (see FIGS. 7 and 8) for guiding a striking mechanism part. Further, rear end parts of the first and second guide shafts 170*a*, 170*b* are supported by the bearing support part 107.

As shown in FIG. 3, the gear housing 105 houses a motion converting mechanism 120, a striking mechanism 140, a rotation transmitting mechanism 150, the tool holder 159 and a clutch mechanism 180. Rotation output of the electric motor 110 is converted into linear motion by the motion converting mechanism 120 via the clutch mechanism 180 and transmitted to the striking mechanism 140. Then the hammer bit 119 held by the tool holder 159 is linearly driven in its axial direction via the striking mechanism 140, so that the hammer bit 119 strikes the workpiece or performs a hammering operation. Further, the rotation transmitting mechanism 150 reduces the speed of the rotating output of the electric motor 110 and transmits it to the hammer bit 119, so that the hammer bit 119 is rotationally driven in a circumferential direction around its axis. Thus, the hammer bit 119 performs a drilling operation on the workpiece. The structure of the striking mechanism 140 will be described below in detail. The striking mechanism 140 is an example embodiment that corresponds to the "striking mechanism" according to the present invention.

The intermediate shaft 116 is mounted in the gear housing 105 and rotationally driven by the electric motor 110. The intermediate shaft 116 is rotatably supported with respect to the gear housing 105 via a front bearing 118*a* mounted to the gear housing 105 and a rear bearing 118*b* mounted to the bearing support part 107. Further, the intermediate shaft 116 cannot move in an axial direction of the intermediate shaft 116 (the longitudinal direction of the hammer drill 100) with respect to the gear housing 105. The clutch mechanism 180 is provided on a rear end part of the intermediate shaft 116. A driven gear 117 which engages with the pinion gear 113 of the electric motor 110 is fitted on the clutch mechanism 180. Like the pinion gear 113, the driven gear 117 is also formed as a helical gear. With such a structure, the intermediate shaft 116 is rotationally driven by the output shaft 111 of the electric motor 110. By forming the driven gear 117 and the pinion gear 113 as helical gears, noise caused in rotation transmission between the pinion gear 113 and the driven gear 117 is suppressed.

(Structure of the Striking Mechanism Part]

Figure 4:
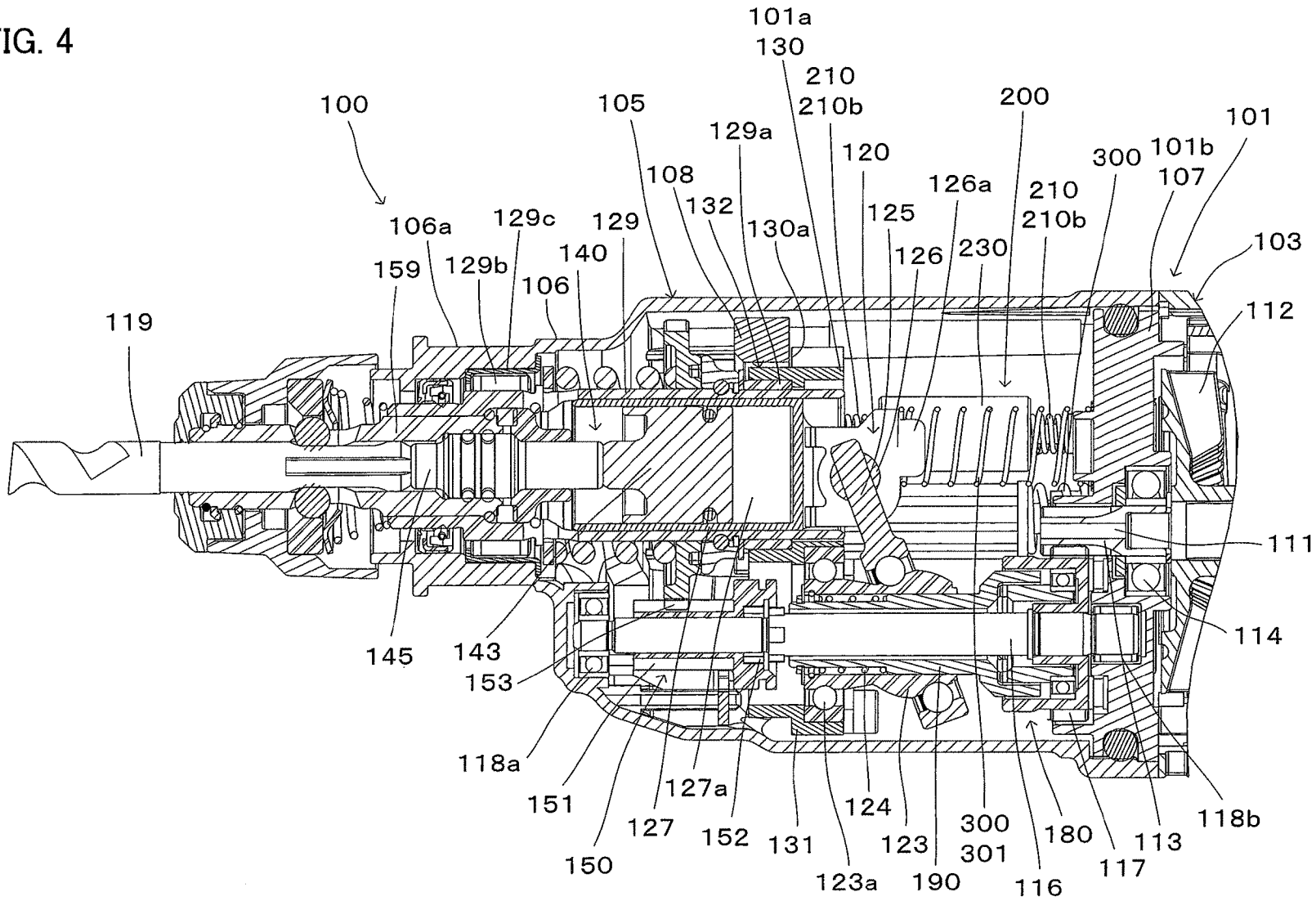
FIG. 4 is a sectional view showing an essential part of the hammer drill.

As shown in FIG. 4, the striking mechanism part which drives the hammer bit 119 for hammering operation of the hammer bit 119 mainly includes the motion converting mechanism 120, the striking mechanism 140 and the tool holder 159. The motion converting mechanism 120 mainly includes a rotary body 123 that is disposed on an outer periphery of the intermediate shaft 116, a swinging shaft 125 that is mounted to the rotary body 123, a joint pin 126 that is connected to a front end part of the swinging shaft 125, a piston 127 that is connected to the joint pin 126 via a connecting element 126*a*, a cylinder 129 that forms a rear region of the tool holder 159 and houses the piston 127, and a holding member 130 that holds the rotary body 123 and the cylinder 129. The holding member 130 includes a lower rotary body holding part 131 and an upper cylinder holding part 132.

As shown in FIG. 4, the rotary body 123 is fitted onto a clutch sleeve 190 of the clutch mechanism 180. The rotary body 123 is spline connected to the clutch sleeve 190 and configured to rotate together with the clutch sleeve 190 and slide in the axial direction of the clutch sleeve 190 (in the longitudinal direction of the hammer drill 100) with respect to the clutch sleeve 190. Specifically, the rotary body 123 can move between a front position and a rear position with respect to the clutch sleeve 190. A coil spring 124 is arranged coaxially with the clutch sleeve 190 between the rotary body 123 and the clutch sleeve 190. A front end of the coil spring 124 is held in contact with a metal ring spring which is mounted on the inside of the rotary body 123, while a rear end of the coil spring 124 is held in contact with a stepped part (shoulder part) of the clutch sleeve 190. Thus, the coil spring 124 biases the rotary body 123 forward, while biasing the clutch sleeve 190 rearward.

As shown in FIG. 4, the rotary body 123 is supported via a bearing 123*a* by a rotary body holding part 131 of the holding member 130. The rotary body holding part 131 is substantially cylindrically shaped to hold the rotary body 123. The intermediate shaft 116 extends through the rotary body 123 and the clutch sleeve 190 in non-contact therewith. Thus, the rotary body 123 is held by the rotary body holding part 131 together with the clutch sleeve 190 so as to be spaced apart from an outer circumferential surface of the intermediate shaft 116 in a radial direction of the intermediate shaft 116. The rotary body 123 can move together with the rotary body holding part 131 in the axial direction of the intermediate shaft 116 (the longitudinal direction of the hammer drill 100) with respect to the intermediate shaft 116.

FIG. 4 shows a state in which the rotary body 123 is located at a front position and not driven (also referred to as a non-driving state). The front position of the rotary body 123 is defined when a wall surface 130*a* formed on the upper side of the holding member 130 comes in contact with the guide support part 108.

As shown in FIG. 4, the swinging shaft 125 is fitted onto an outer periphery of the rotary body 123 and extends upward from the rotary body 123. The joint pin 126 is rotatably connected to the front end part (upper end part) of the swinging shaft 125. The joint pin 126 is connected to a bottomed cylindrical piston 127 via the connecting element 126*a* and can move in the axial direction of the swinging shaft 125 with respect to the swinging shaft 125. Therefore, when rotation of the intermediate shaft 116 is transmitted to the rotary body 123 and the rotary body 123 is rotationally driven, the swinging shaft 125 mounted on the rotary body 123 is caused to swing in the longitudinal direction of the hammer drill 100 (a back-and-forth direction as viewed in FIG. 2). As a result, the piston 127 is caused to linearly reciprocate in the longitudinal direction of the hammer drill 100 within the cylinder 129.

As shown in FIG. 4, a rear end part of the cylinder 129 is supported via a bearing 129*a* by a cylinder holding part 132 of the holding member 130. The holding member 130 keeps the distance between the rotary body 123 and the cylinder 129 constant. Therefore, when the rotary body 123, the swinging shaft 125, the joint pin 126, the connecting element 126*a* and the piston 127 move in the axial direction of the intermediate shaft 116 (the longitudinal direction of the hammer drill 100) with respect to the intermediate shaft 116, the cylinder 129 also moves in the axial direction of the intermediate shaft 116. Specifically, components of the motion converting mechanism 120 are integrally held (connected) by the holding member 130 and form an assembly (also referred to as a motion converting mechanism assembly).

Further, the "striking mechanism" according to the present invention is described above as the "striking mechanism 140" according to this embodiment, but it may be a structure having the rotary body 123, the swinging shaft 125, the joint pin 126, the connecting element 126*a* and the piston 127 in addition to the striking mechanism 140.

As shown in FIG. 4, the striking mechanism 140 mainly includes a striking element in the form of a striker 143 that is slidably disposed in the piston 127, and an impact bolt 145 that is disposed in front of the striker 143 and with which the striker 143 collides. Further, a space behind the striker 143 within the piston 127 is defined as an air chamber 127*a* which functions as an air spring.

When the piston 127 is moved in the back-and-forth direction by swinging movement of the swinging shaft 125, air pressure of the air chamber 127*a* fluctuates, so that the striker 143 slides in the longitudinal direction of the hammer drill 100 within the piston 127 by the action of the air spring. When the striker 143 is moved forward, the striker 143 collides with the impact bolt 145 and the impact bolt 145 collides with the hammer bit 119 held by the tool holder 159. As a result, the hammer bit 119 is moved forward and performs a hammering operation on the workpiece.

As shown in FIG. 4, the tool holder 159 is a substantially cylindrical member and coaxially and integrally connected to the cylinder 129. In a rear end region of the tool holder 159 connected to the cylinder 129, a bearing 129*b* is fitted on the cylinder 129. The bearing 129*b* is held in a cylindrical bearing case 129*c*. The bearing case 129*c* is fixed to the barrel part 106*a* of the gear housing 105. Therefore, the tool holder 159 and the cylinder 129 are supported via the bearing 129*b* and the bearing case 129*c* in such a manner as to be slidable in the longitudinal direction and rotatable around the axis with respect to the barrel part 106*a*. The tool holder 159 and the cylinder 129 are held by the cylinder holding part 132 of the holding member 130. Therefore, the motion converting mechanism 120, the striking mechanism 140 and the tool holder 159 are integrally connected together via the holding member 130 to form an assembly (also referred to as a striking mechanism assembly).

(Relationship between the Striking Mechanism Part, the Vibration Reducing Mechanism and the Cushioning Mechanism)

Figure 5:
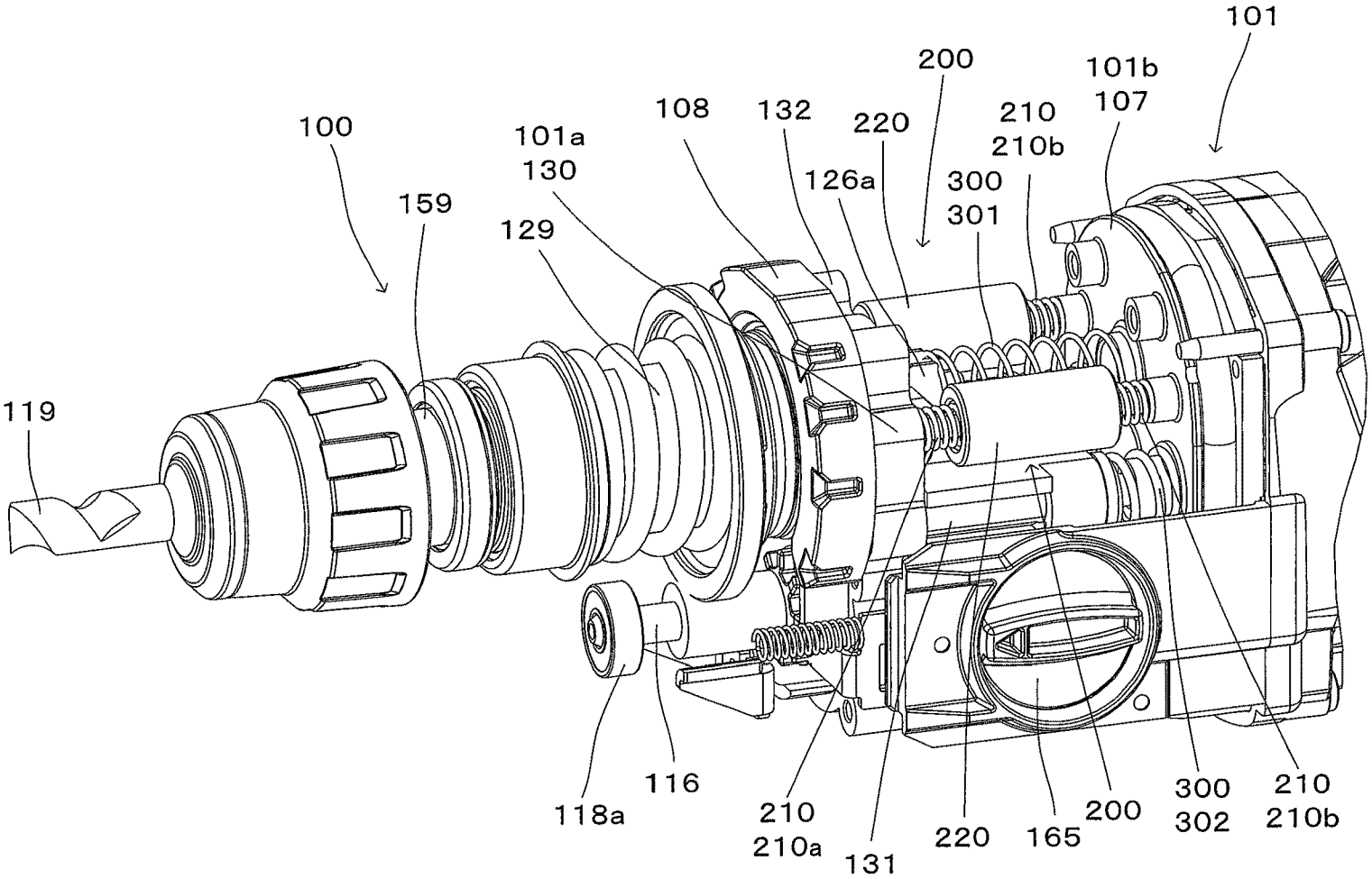
FIG. 5 is a view for showing the essential part of the hammer drill.
Figure 6:
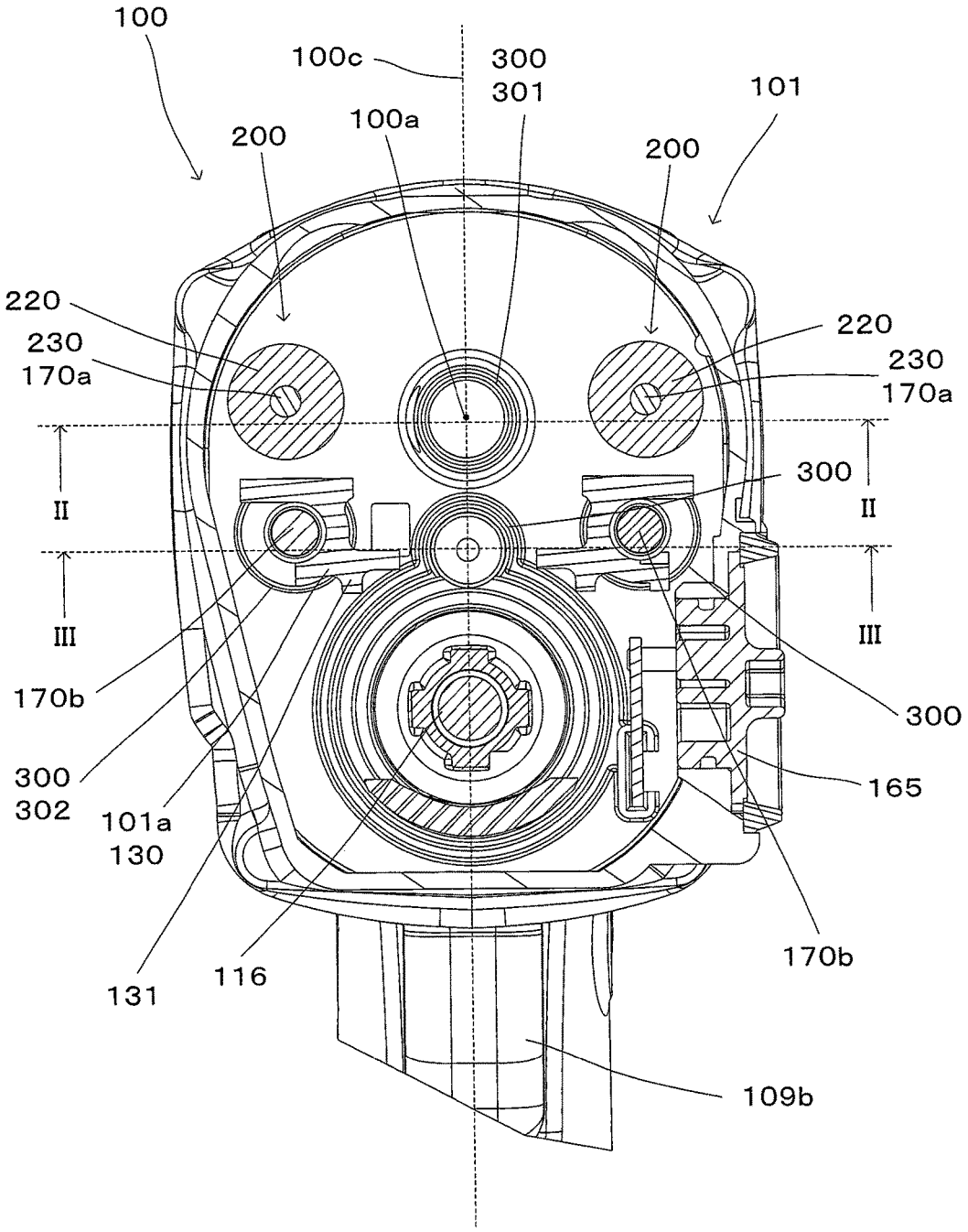
FIG. 6 is a sectional view taken along line I-I in FIG. 3.
Figure 7:
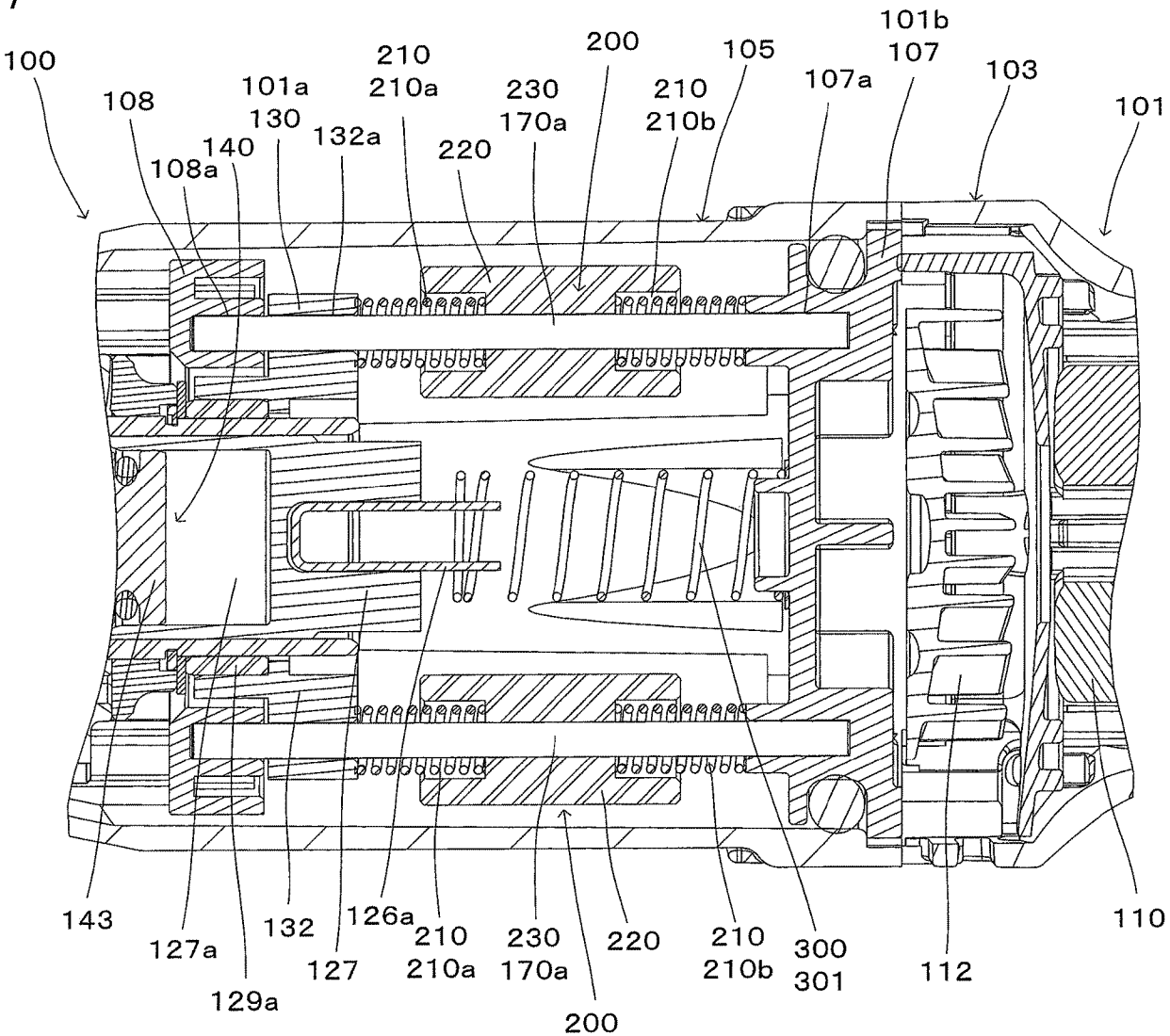
FIG. 7 is a sectional view taken along line II-II in FIG. 6.
Figure 8:
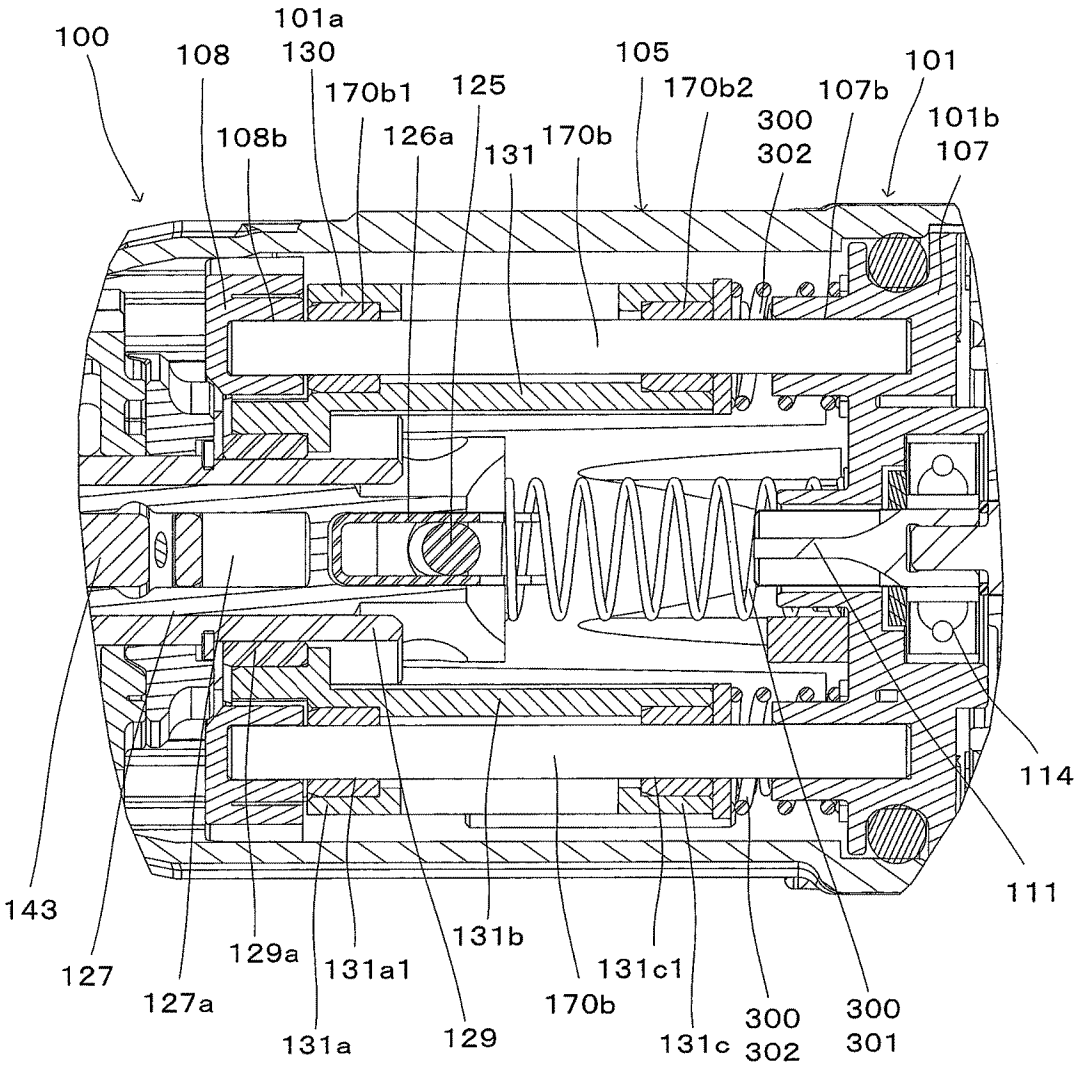
FIG. 8 is a sectional view taken along line in FIG. 6.

The relationship between the striking mechanism part, the vibration reducing mechanism 200 and the cushioning mechanism 300 are explained with reference to FIGS. 5 to 8. FIG. 5 is a view for showing the hammer drill 100 with the housing part 106 removed therefrom. FIG. 6 is a sectional view taken along line I-I in FIG. 3. FIG. 7 is a sectional view taken along line II-II in FIG. 6. FIG. 8 is a sectional view taken along line in FIG. 6.

The above-described striking mechanism assembly is movably held in the longitudinal direction of the hammer drill 100 (the axial direction of the hammer bit 119) with respect to the gear housing 105. Specifically, as shown in FIGS. 6 to 8, four guide shafts, i.e. a pair of upper first guide shafts 170*a* and a pair of lower second guide shaft 170*b*, are mounted to the bearing support part 107 and the guide support part 108. As shown in FIGS. 7 and 8, the first and second guide shafts 170*a*, 170*b* are arranged to extend in parallel to the axial direction of the hammer bit 119. Further, each of the first and second guide shafts 170*a*, 170*b* is formed as an elongate member having a circular section, but it may have a polygonal section.

As shown in FIG. 7, each of the first guide shafts 170*a* is arranged to extend between a guide receiving hole 108*a* of the guide support part 108 and a guide receiving hole 107*a* of the bearing support part 107. The guide receiving holes 108*a* and 107*a* are not through holes and hold the first guide shaft 170*a* between their respective bottoms. With this structure, the first guide shaft 170*a* is fixed between the guide support part 108 and the bearing support part 107 so as not to move in the longitudinal direction.

Further, the first guide shaft 170*a* is inserted through a guide insert hole 132*a* formed in the cylinder holding part 132 of the holding member 130. The vibration reducing mechanism 200 is disposed between the cylinder holding part 132 and the bearing support part 107.

The vibration reducing mechanism 200 of the hammer drill 100 according to the first embodiment is configured as a dynamic vibration reducer having a weight part 220 and an elastic member 210. The elastic member 210 includes a first elastic member 210*a* disposed on the cylinder holding part 132 side and a second elastic member 210*b* disposed on the bearing support part 107 side. The weight part 220 is disposed between the first elastic member 210*a* and the second elastic member 210*b*. Specifically, the elastic member 210 (the first elastic member 210*a*, the second elastic member 210*b*) and the weight part 220 are arranged coaxially with the first guide shaft 170*a* and configured to reciprocatingly slide with respect to the first guide shaft 170*a*. The vibration reducing mechanism 200, the first guide shaft 170*a*, the first elastic member 210*a*, the second elastic member 210*b* and the weight part 220 are example embodiments that correspond to the "vibration reducing mechanism", the "guide part", the "first elastic member", the "second elastic member" and the "weight part", respectively, according to the present invention.

A weight element having a prescribed weight and shape forms the weight part 220. In the vibration reducing mechanism 200 according to the first embodiment, the weight element is arranged on each of a pair of the first guide shafts 170*a*. Specifically, the weight part 220 is formed by providing two weight elements. The number of the weight elements is determined by the structure of the hammer drill 100 to be obtained. Specifically, one or more weight elements may be provided. Particularly, a plurality of weight elements may be provided on a single first guide shaft 170*a*. Further, two or more first guide shafts 170*a* may be provided, and the weight element and the elastic member 210 may be provided on each of the first guide shafts 170*a*.

When the hammer drill 100 is viewed from the front with respect to the central plane 100*c*, the extending axis of the striking mechanism 140 and the extending axis of the vibration reducing mechanism 200 have regions overlapping each other. Here, the hammer drill 100 viewed from the front with respect to the central plane 100*c* represents the hammer drill 100 viewed from a direction perpendicular to the longitudinal direction of the hammer drill 100, for example, as shown in FIG. 3. With such a structure, the weight part 220 is efficiently driven to reciprocate by vibration caused by the striking mechanism 140.

FIG. 6 is a sectional view taken along line I-I in FIG. 3 and showing the handgrip 109 side of the hammer drill 100. In FIG. 6, for convenience sake, the central axis 100*a* and the central plane 100*c* are shown by a dot and a line, respectively. The center of gravity of the weight part 220 is located on the central plane 100*c*. With this structure, the vibration reducing mechanism 200 stably reduces vibration caused by driving of the striking mechanism 140.

Further, the hammer drill 100 may be configured to have its center of gravity on the central plane 100*c*. In this case, the center of gravity of the hammer drill 100 and the center of gravity of the weight part 220 are located on the same plane. Therefore, the user can hold the hammer drill 100 with stability, resulting in that the vibration reducing mechanism 200 can achieve a further higher vibration reducing effect.

As shown in FIG. 8, each of the second guide shafts 170*b* is arranged to extend between a guide receiving hole 108*b* of the guide support part 108 and a guide receiving hole 107*b* of the bearing support part 107. The guide receiving holes 108*b* and 107*b* are not through holes and hold the second guide shaft 170*b* between their respective bottoms. With this structure, the second guide shaft 170*b* is fixed between the guide support part 108 and the bearing support part 107 without moving in the longitudinal direction.

Further, the second guide shaft 170*b* is supported through the rotary body holding part 131. Specifically, the rotary body holding part 131 has a front part 131*a*, a rear part 131*c* and an intermediate part 131*b* extending between the front part 131*a* and the rear part 131*c*. In the front part 131*a*, the second guide shaft 170*b* is inserted through a guide insert hole 131*a*1 via a bearing 170*b*1. In the rear part 131*b*, the second guide shaft 170*b* is inserted through a guide insert hole 131*c*1 via a bearing 170*b*2.

A second cushioning elastic member 302 is disposed coaxially with the second guide shaft 170*b* between the rear part 131*c* and the bearing support part 107. A first cushioning elastic member 301 is disposed between the connecting element 126*a* fixed to the piston 127 and the bearing support part 107. The first and second cushioning elastic members 301, 302 are coil springs and form the cushioning mechanism 300 described above with reference to FIG. 1. With this structure, the holding member 130 is biased forward by the cushioning mechanism 300 (the first cushioning elastic member 301, the second cushioning elastic member 302). The cushioning mechanism 300 is an example embodiment that corresponds to the "cushioning mechanism" according to the present invention.

The holding member 130 and the striking mechanism part (the motion converting mechanism 120, the striking mechanism 140 and the tool holder 159) are biased forward by the cushioning mechanism 300. At this time, as shown in FIG. 4, the wall surface 130*a* formed on the upper side of the holding member 130 comes in contact with the guide support part 108, so that the holding member 130 and the striking mechanism part are prevented from moving forward.

(Structure of the Clutch Mechanism)

The above-described striking mechanism part is driven by the electric motor 110 via the clutch mechanism 180. The clutch mechanism 180 is configured to be switched between a power transmission state and a power non-transmission state. Therefore, when the clutch mechanism 180 is in the power transmission state, the motion converting mechanism 120 is driven and the striking mechanism 140 strikes the hammer bit 119, so that hammering operation is performed. The clutch mechanism 180 is not further elaborated here for convenience of explanation of the present invention.

(Structure of the Rotation Transmitting Mechanism)

As shown in FIG. 4, the rotation transmitting mechanism 150 mainly includes a gear speed reducing mechanism having a plurality of gears such as a first gear 151 which is coaxially disposed with the intermediate shaft 116 and a second gear 153 which engages with the first gear 151. The second gear 153 is fitted onto the cylinder 129 and transmits rotation of the first gear 151 to the cylinder 129. When the cylinder 129 is rotated, the tool holder 159 integrally connected to the cylinder 129 is rotated. As a result, the hammer bit 119 held by the tool holder 159 is rotationally driven. The rotation transmitting mechanism 150 is an example embodiment that corresponds to the "rotary drive mechanism" according to the present invention.

As shown in FIG. 4, the first gear 151 is a substantially cylindrical member and is loosely fitted onto the intermediate shaft 116. The first gear 151 has a spline engagement part 152 and can engage with a spline groove formed in the intermediate shaft 116. Therefore, the first gear 151 is configured to rotate together with the intermediate shaft 116 and slide with respect to the intermediate shaft 116 in the back-and-forth direction. Specifically, when the first gear 151 is located at a front position, the spline engagement part 152 of the first gear 151 does not engage with the intermediate shaft 116 and rotation of the intermediate shaft 116 is not transmitted to the first gear 151, so that the first gear 151 does not rotate. On the other hand, when the first gear 151 is located at a rear position, the spline engagement part 152 of the first gear 151 engages with the intermediate shaft 116 and rotation of the intermediate shaft 116 is transmitted to the first gear 151, so that the first gear 151 rotates together with the intermediate shaft 116. FIG. 4 shows the state in which the first gear 151 is located at the front position.

The second gear 153 is configured to move in the axial direction of the first gear 151 with respect to the first gear 151 when the cylinder 129 (the tool holder 159) moves in the back-and-forth direction, while being always held in engagement with the first gear 151.

When the first gear 151 is rotationally driven, the second gear 153 engaged with the first gear 151 is rotated. Thus, the tool holder 159 connected to the cylinder 129 is rotationally driven and the hammer bit 119 held by the tool holder 159 is rotationally driven around its axis, so that the hammer bit 119 performs a drilling operation on the workpiece.

(Operation of the Hammer Drill)

By user's operation of the changeover dial 165 shown in FIG. 5, the first gear 151 is switched between the front position and the rear position. Further, by the operation of the changeover dial 165, rearward movement of the holding member 130 is allowed or prevented.

Specifically, the changeover dial 165 can be switched to select a state in which the first gear 151 is placed in the rear position and the holding member 130 is allowed to move rearward. In this case, hammer drill mode is selected as the drive mode, and the rotation transmitting mechanism 150 and the striking mechanism part can be driven.

Further, the changeover dial 165 can also be switched to select a state in which the first gear 151 is placed in the front position and the holding member 130 is allowed to move rearward. In this case, hammer mode is selected as the drive mode, and the striking mechanism part can be driven while the rotation transmitting mechanism 150 is not driven.

Furthermore, the changeover dial 165 can also be switched to select a state in which the first gear 151 is placed in the rear position and the holding member 130 is prevented from moving rearward. In this case, drill mode is selected as the drive mode, and the rotation transmitting mechanism 150 can be driven while the striking mechanism part is not driven.

Figure 9:
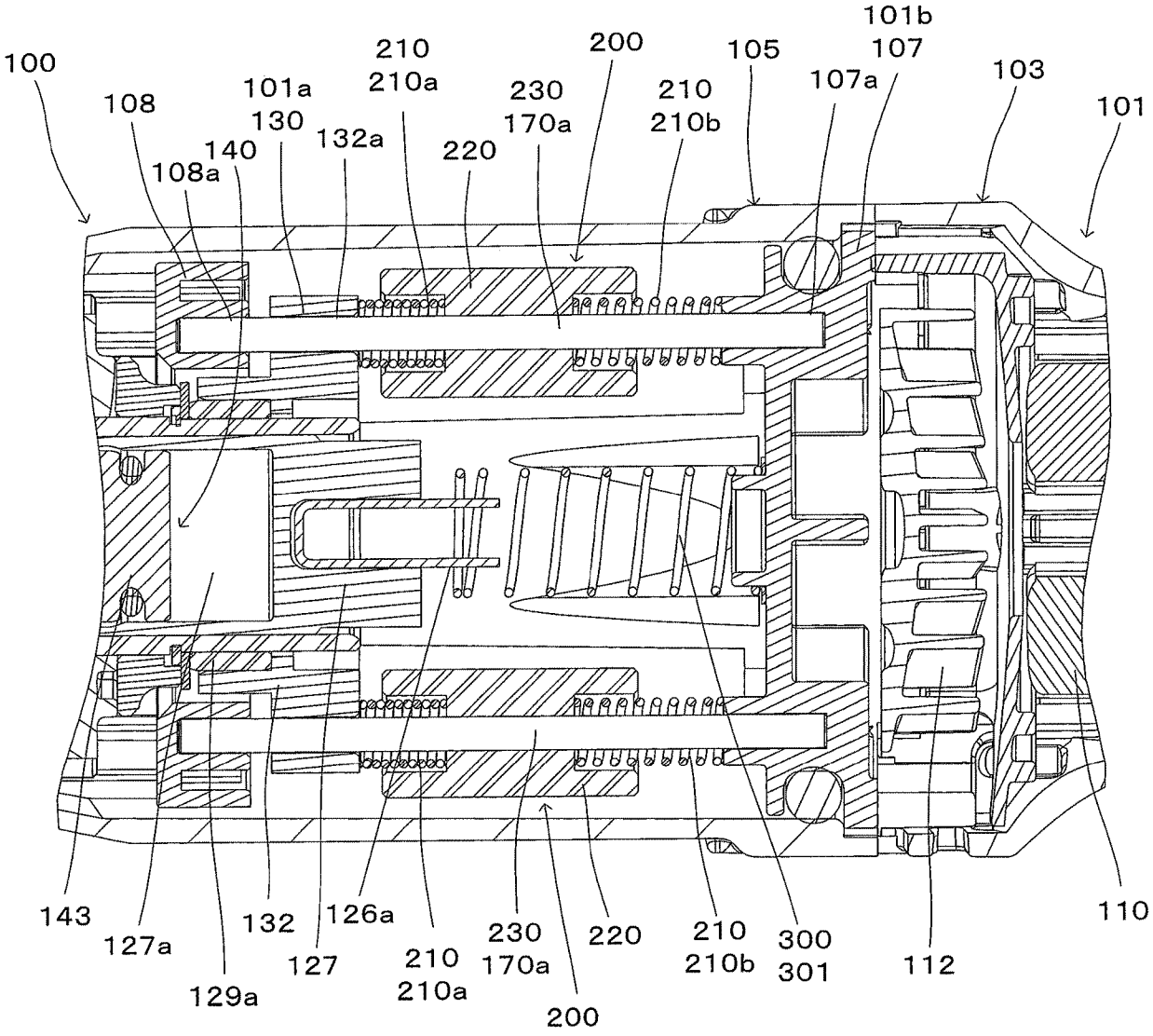
FIG. 9 is a view for showing operation of the hammer drill.

The state in the hammer drill mode or the hammer mode is described with reference to FIG. 9. FIG. 9 shows the state in which the weight part 220 of the vibration reducing mechanism 200 is located at a front position.

When a user presses the hammer bit 119 against a workpiece, the motion converting mechanism 120, the striking mechanism 140 and the tool holder 159 (the striking mechanism assembly) which are integrally connected together via the holding member 130 are moved rearward against biasing forces of the first and second cushioning elastic members 301, 302 of the cushioning mechanism 300. In this state, when the user operates the trigger 109*a*, the hammer bit 119 is impact driven.

In this state, vibration caused by the striking mechanism 140 is absorbed by the vibration reducing mechanism 200 and the cushioning mechanism 300. Particularly, the vibration reducing mechanism 200 in the form of the dynamic vibration reducer efficiently reduces vibration caused by driving of the striking mechanism 140 by reciprocating movement of the weight part 220 between the first elastic member 210*a* and the second elastic member 210*b*. As a result, vibration received by the striking mechanism 140 is reduced, so that reduction of the striking force of the striking mechanism 140 is suppressed. Further, transmission of vibration to the handgrip 109 via the bearing support part 107 is also reduced by the vibration reducing mechanism 200 and the cushioning mechanism 300. Therefore, transmission of vibration to the user is reduced.

Second Embodiment

Figure 10:
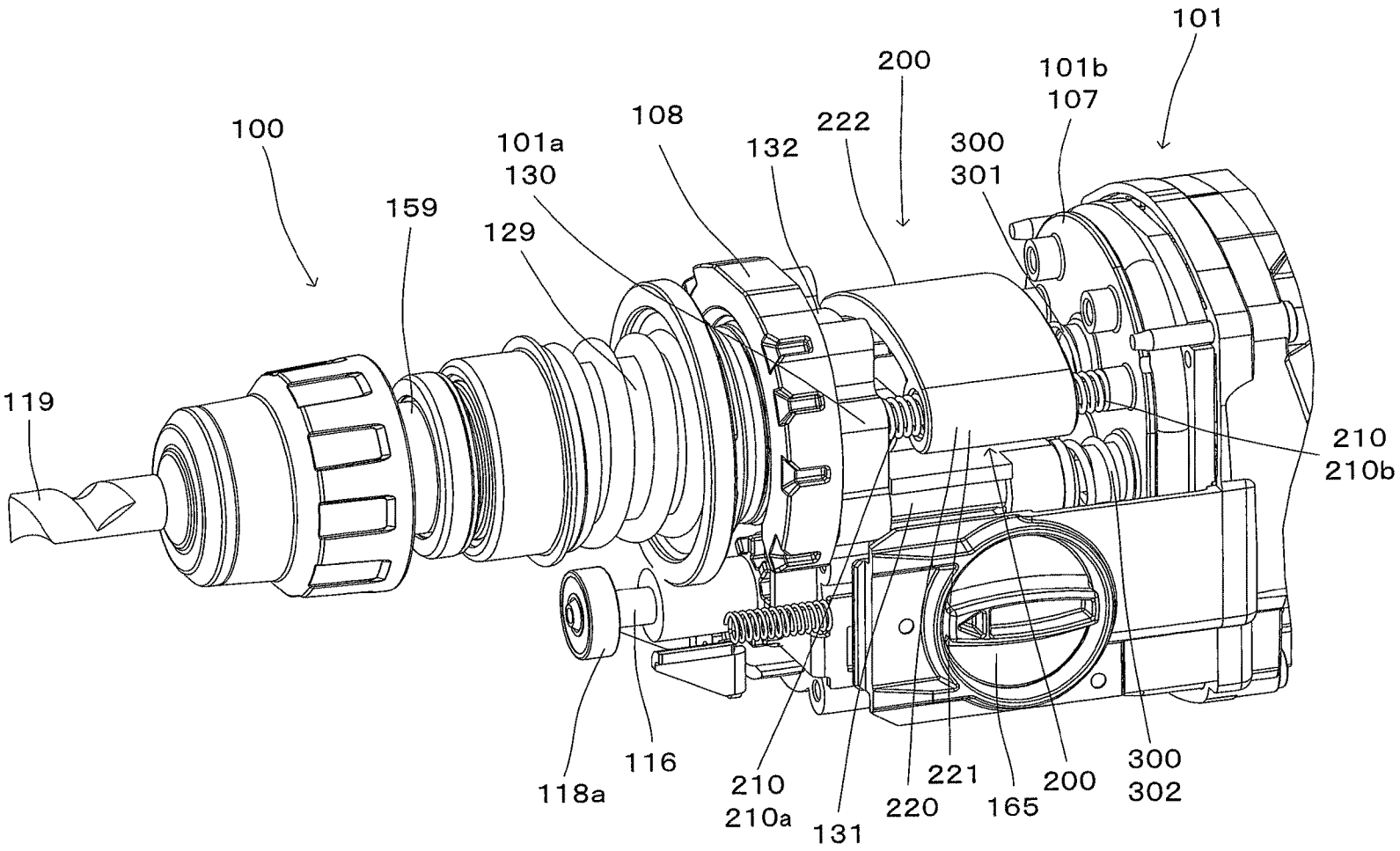
FIG. 10 is a view for showing an essential part of a hammer drill according to a second embodiment of the present invention.

A hammer drill 100 according to a second embodiment of the present invention is now explained with reference to FIG. 10. The hammer drill 100 of the second embodiment is different from that of the first embodiment in the structure of the cushioning mechanism 300. Specifically, the weight part 220 has a pair of cylindrical parts 221 respectively fitted on a pair of first guide shafts 170*a*, and a connecting part 222 connecting the cylindrical parts 221.

In the hammer drill 100 according to the second embodiment, the weight part 220 consisting of a single weight element can be more easily mounted to the first guide shafts 170*a*.

In the above-described embodiments, the handgrip 109 is formed in a cantilever form extending downward from the motor housing 103, but the form of the handgrip 109 should not be construed in a limiting sense. For example, the handgrip 109 may be formed in a loop shape such that the distal end of the handgrip 109 is further connected to the motor housing 103.

In the above-described embodiments, the output shaft 111 of the electric motor 110 is arranged to extend in parallel to the axis of the hammer bit 119, but the arrangement of the output shaft 111 should not be construed in a limiting sense. For example, the output shaft 111 of the electric motor 110 may be arranged to cross the axis of the hammer bit 119. In this case, it is preferred that the output shaft 111 and the intermediate shaft 116 are engaged with each other via a bevel gear. Further, it is preferred that the output shaft 111 is arranged perpendicularly to the axis of the hammer bit 119.

In the above-described embodiments, the pinion gear 113 and the driven gear 117 are formed as a helical gear, but the gear should not be construed in a limiting sense. For example, a gear such as a spur gear and a bevel gear may be used.

In view of the nature of the above-described invention, the impact tool according to this invention can be provided with the following features. Each of the features can be used separately or in combination with the other, or in combination with the claimed invention.

(Aspect 1)

An extending axis of the vibration reducing mechanism is arranged closer to an extending axis of the striking mechanism than to an extending axis of the cushioning mechanism.

(Aspect 2)

The extending axis of the vibration reducing mechanism extends in parallel to the extending axis of the striking mechanism.

Third Embodiment

Figure 11:
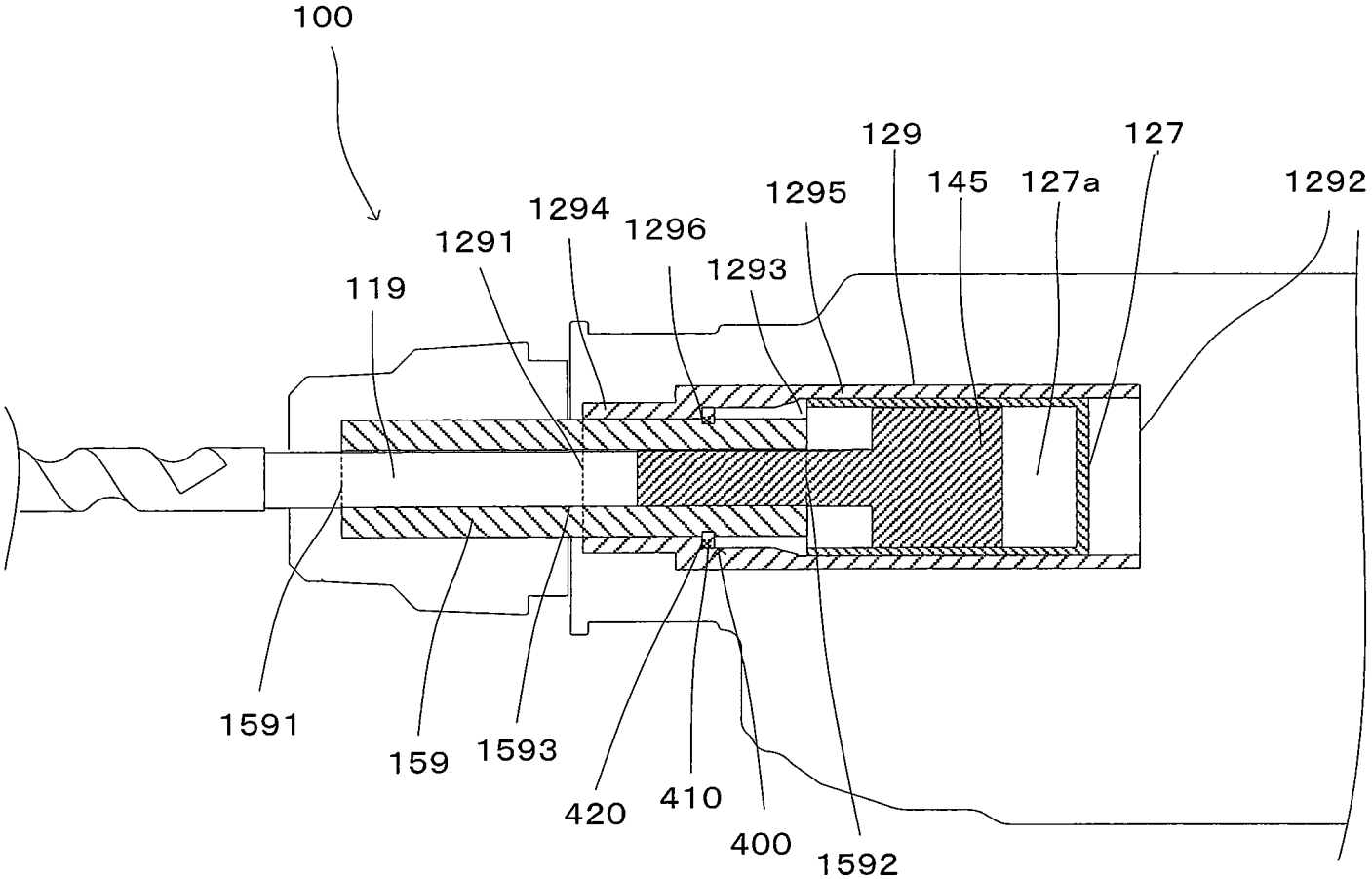
FIG. 11 is a schematic view for showing a summary of a third embodiment of the present invention.

An impact tool according to a third embodiment of the present invention is now summarized with reference to FIG. 11. The impact tool 100 is configured to perform a prescribed hammering operation on a workpiece by driving a tool accessory 119 in a prescribed longitudinal direction and has a tool holder 159 which holds the tool accessory 119, and a striking mechanism part. The longitudinal direction in which the tool accessory 119 is driven coincides with the axial direction of the tool accessory 119 attached to the impact tool 100. The striking mechanism part includes a housing cylinder 129 that is integrally formed with the tool holder 159, a piston 127 that is housed in the housing cylinder 129, a striking element 145, and an air chamber 127*a* that is defined by the piston 127 and the striking element 145. With this structure, the striking element 145 is driven by pressure fluctuations which are caused within the air chamber 127*a* by the movement of the piston 127, and the tool accessory 119 is driven in the longitudinal direction via the striking force of the striking element 145.

In the longitudinal direction, the front side of the tool holder 159 is defined as a front side and the opposite side is defined as a rear side. In this definition, the left and right sides in FIG. 11 correspond to the front and rear sides, respectively. The housing cylinder 129 has a cylindrical hollow structure having a front open end 1291, a rear open end 1292 and an inner peripheral part 1293*c*. Further, the housing cylinder 129 has a small-diameter part 1294 and a large-diameter part 1295 which have different inner diameters. The piston 127 is housed in the large-diameter part 1295 and caused to linearly reciprocate in the back-and-forth direction.

The tool holder 159 has a cylindrical hollow structure having a front open end 1591, a rear open end 1592 and an inner peripheral part 1593. The tool accessory 119 can be removably coupled to the inner peripheral part 1593 through the front open end 1591.

The tool holder 159 is press-fitted into the housing cylinder 129 from the rear open end 1292 toward the front open end 1291 up to a prescribed position in the housing cylinder 129. At this time, the tool holder 159 inserted into the housing cylinder 129 from the rear open end 1292 can be press-fitted to the prescribed position in the housing cylinder 129 simply by moving the tool holder 159 toward the front open end 1291 of the housing cylinder 129. As a result, the tool holder 159 and the housing cylinder 129 are integrated together. This means that the positional relation between the tool holder 159 and the housing cylinder 129 is fixed even during hammering operation of the impact tool 100 so as not to cause any trouble in the hammering operation. Even if the positional relation between the tool holder 159 and the housing cylinder 129 varies within a range that causes no trouble in the hammering operation, the tool holder 159 and the housing cylinder 129 are construed as being "integrated together" according to this invention.

In regions of an inner peripheral surface of the housing cylinder 129 and an outer peripheral surface of the tool holder 159 which come in contact with each other by press fitting, any other structure which may become resistance to the press fitting operation is not formed. Specifically, in these regions, a structure protruding from the inner peripheral surface of the housing cylinder 129 or a structure protruding from the outer peripheral surface of the tool holder 159 is not formed. In this sense, it can be said that these regions of the inner peripheral surface of the housing cylinder 129 and the outer peripheral surface of the tool holder 159 form a smooth region, and further the smooth region can also be referred to as an obstacle-free region.

Further, a structure which does not become resistance to the press fitting operation may be formed in the smooth region (obstacle-free region). For example, a recess may be formed in the inner peripheral surface of the housing cylinder 129 or the outer peripheral surface of the tool holder 159. Further, any other structure may be formed in such a recess. In this case, the "other structure" needs to be configured not to become substantial resistance to the press fitting operation A preventing mechanism 400 is provided to prevent the tool holder 159 from further moving forward when the tool holder 159 and the housing cylinder 129 are integrated together.

The preventing mechanism 400 includes a restriction part 410 on the tool holder 159 and a stop part 420 on the housing cylinder 129. When the tool holder 159 and the housing cylinder 129 are integrated together, the restriction part 410 comes in contact with the stop part 420 and prevents further movement of the tool holder 159. Specifically, when the tool holder 159 is press-fitted into the housing cylinder 129, the preventing mechanism 400 stops further movement of the tool holder 159. In this sense, the preventing mechanism 400 can be an index part for indicating that the tool holder 159 is press-fitted in up to the prescribed position of the housing cylinder 129.

Further, it may also be configured such that the restriction part 410 is not held in contact with the stop part 420 at the prescribed position if the tool holder 159 and the housing cylinder 129 are held "integrated together".

In the impact tool 100 having the above-described structure, the tool holder 159 and the housing cylinder 129 are held integrated together during hammering operation, so that the operation can be smoothly performed.

In order to separate the tool holder 159 and the housing cylinder 129, for example, for repair when necessary, the press-fitted state of the tool holder 159 to the housing cylinder 129 can be released. Specifically, the tool holder 159 can be moved toward the rear open end 1292 of the housing cylinder 129 by application of a prescribed pressure to the front of the tool holder 159 in a direction from the front open end 1291 toward the rear open end 1292 of the housing cylinder 129. By further moving the tool holder 159 in this manner, the tool holder 159 can be removed through the rear open end 1292 of the housing cylinder 129. The housing cylinder 129 and the tool holder 159 separated from each other can be reused. Specifically, the housing cylinder 129 and the tool holder 159 can be integrated together again.

Fourth Embodiment

Figure 12:
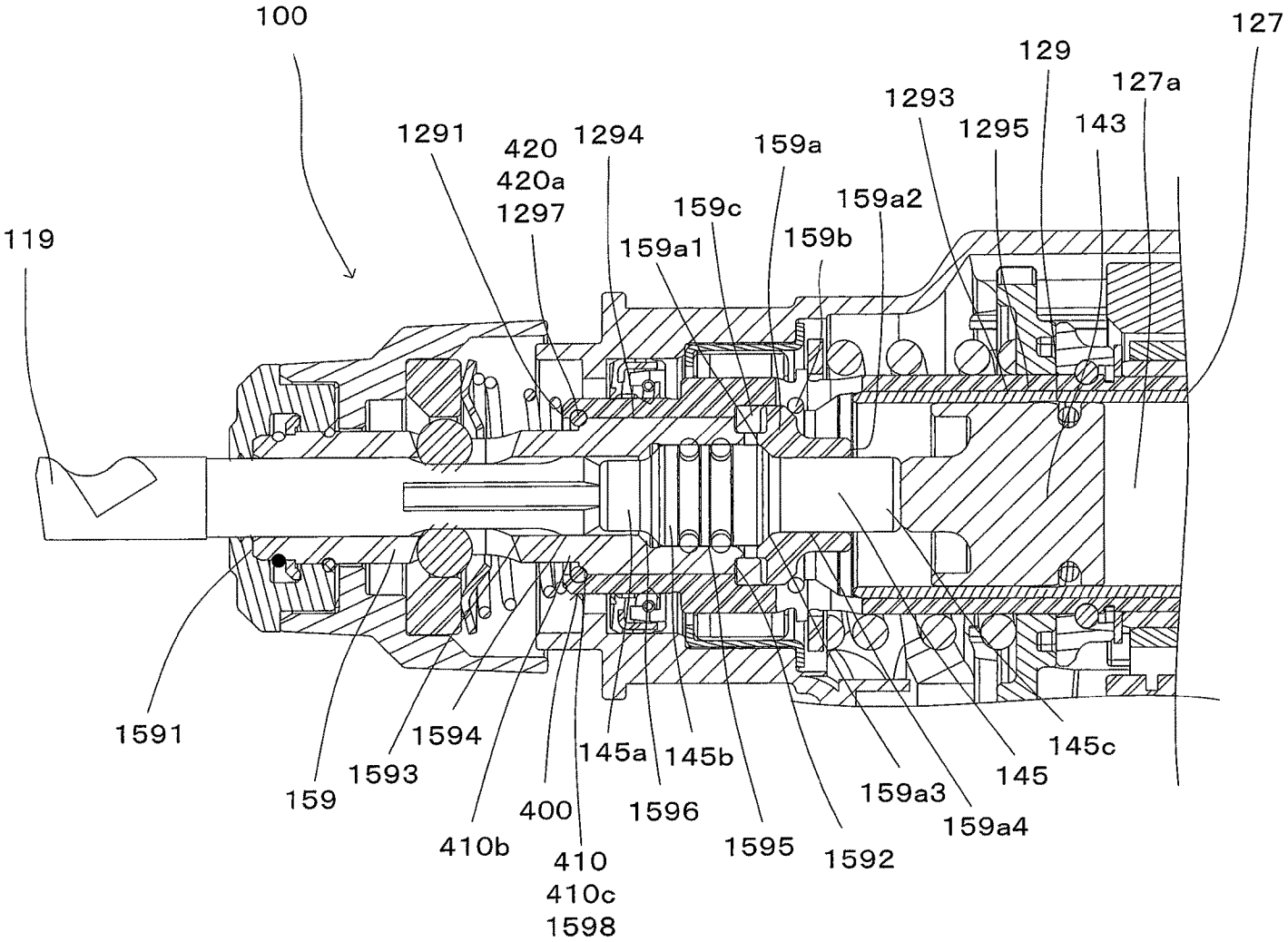
FIG. 12 is a view for showing a hammer drill according to a fourth embodiment of the present invention.

A hammer drill 100 according to a fourth embodiment of the present invention is now explained with reference to FIG. 12. The hammer drill 100 of the fourth embodiment is different from that of the third embodiment in the structure of the preventing mechanism 400.

Specifically, the stop part 420 of the cylinder 129 is a ring spring 1297. A circumferential groove is formed in the inner peripheral region of the cylinder 129 close to the front open end 1291, and the ring spring 1297 is fitted in the circumferential groove. The ring spring 1297 which forms the preventing mechanism 400 is a separate part from the cylinder 129 and the tool holder 159. Therefore, the ring spring 1297 can be referred to as a fixed member 420*a* in the preventing mechanism 400. The fixed member 420*a* is an example embodiment that corresponds to the "fixed member" according to the present invention. Further, the restriction part 410 of the tool holder 159 is formed by forming a wall surface 1598 on a small-diameter part 1594.

As described above, the restriction part 410 can be formed by extending part of the tool holder 159. Specifically, the tool holder 159 can have a prescribed first region 410*b* in its outer periphery and a second region 410*c* protruding from the first region 410*b* in a direction crossing the longitudinal direction of the hammer drill. In such a structure, the second region 410*c* can form the restriction part 410. In the hammer drill of the fourth embodiment, the small-diameter part 1594 has the first region 410*b* and the second region 410*c* having a larger outer diameter than that of the first region 410*b*. Further, the wall surface 1598 is part of the second region 410*c* which is formed at the boundary between the first region 410*b* and the second region 410*c* and configured as the restriction part 410. The first region 410*b* and the second region 410*c* are example embodiments that correspond to the "first region" and the "second region", respectively, according to the present invention.

When the tool holder 159 is press-fitted into the cylinder 129, the wall surface 1598 (the restriction part 410) comes in contact with the ring spring 1297 (the stop part 420). As a result, the tool holder 159 and the cylinder 129 are integrated together, and the tool holder 159 is prevented from further moving forward.

Like in the hammer drill 100 of the third embodiment, in the hammer drill 100 of the fourth embodiment, the tool holder 159 and the cylinder 129 can be separated from each other by moving the tool holder 159 rearward.

Fifth Embodiment

Figure 13:
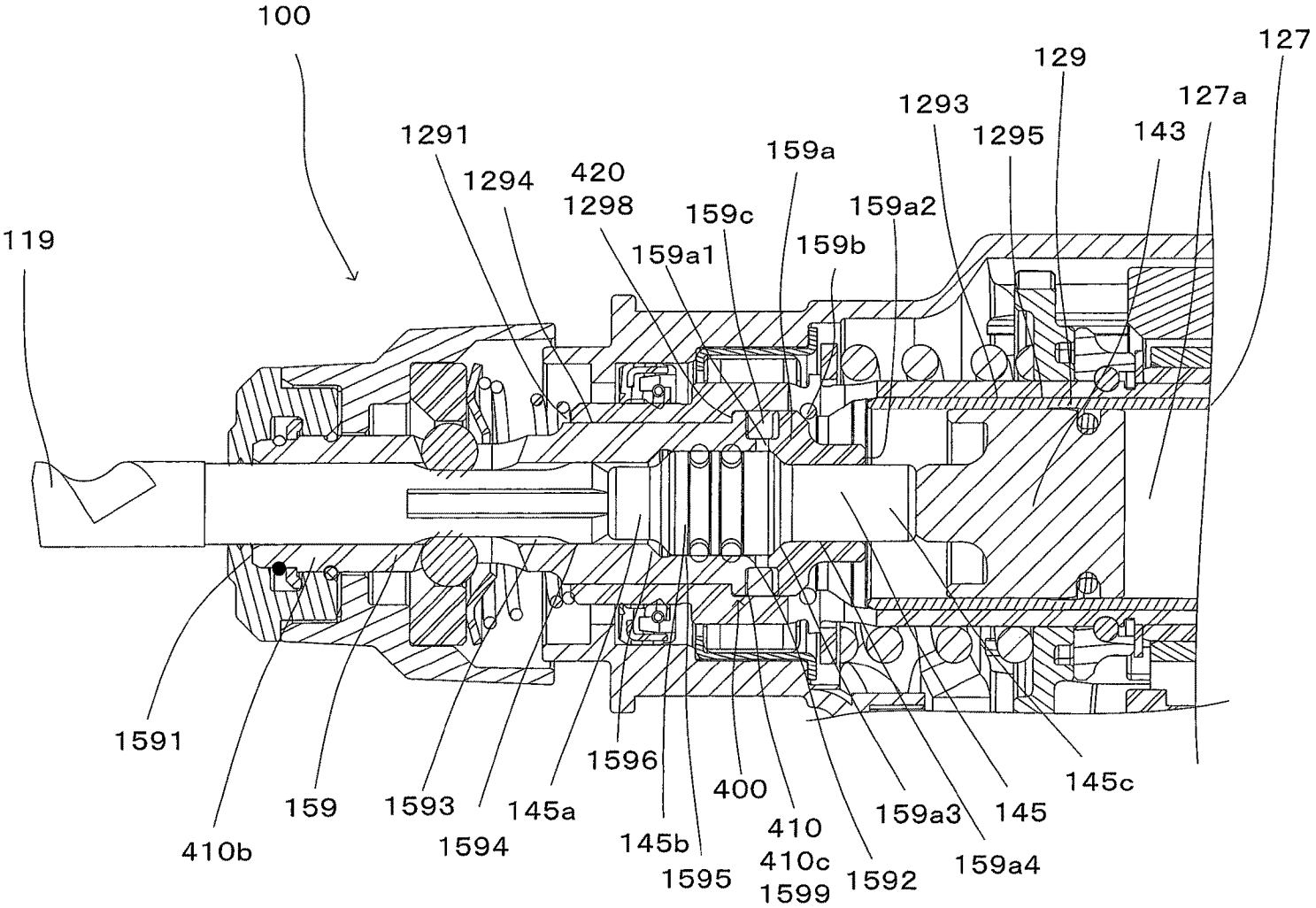
FIG. 13 is a view for showing a hammer drill according to a fifth embodiment of the present invention.

A hammer drill 100 according to a fifth embodiment of the present invention is now explained with reference to FIG. 13. The hammer drill 100 of the fifth embodiment is different from that of the third embodiment in the structure of the preventing mechanism 400.

Specifically, the restriction part 410 of the tool holder 159 is a flange 1599 formed on the periphery of a large-diameter part 1595. Thus, in the large-diameter part 1595, a region having the flange 1599 forms the second region 410*c* and a region not having the flange 1599*a* forms the first region 410*b*.

Further, the stop part 420 of the cylinder 129 is a wall surface 1298. The wall surface 1298 is provided by forming regions having different diameters in the inner periphery of a small-diameter part 1294. Specifically, the wall surface 1298 is formed by a step at the boundary between the regions having different diameters. The front one of the regions having different diameters in the small-diameter part 1294 has a smaller diameter than the rear region.

When the tool holder 159 is press-fitted into the cylinder 129, the flange 1599 comes into contact with the wall surface 1298. As a result, the tool holder 159 and the housing cylinder 129 are integrated together, and the tool holder 159 is prevented from further moving forward.

Like in the hammer drill 100 of the third embodiment, in the hammer drill 100 of the fifth embodiment, the tool holder 159 and the cylinder 129 can be separated from each other by moving the tool holder 159 rearward.

Sixth Embodiment

Figure 14:
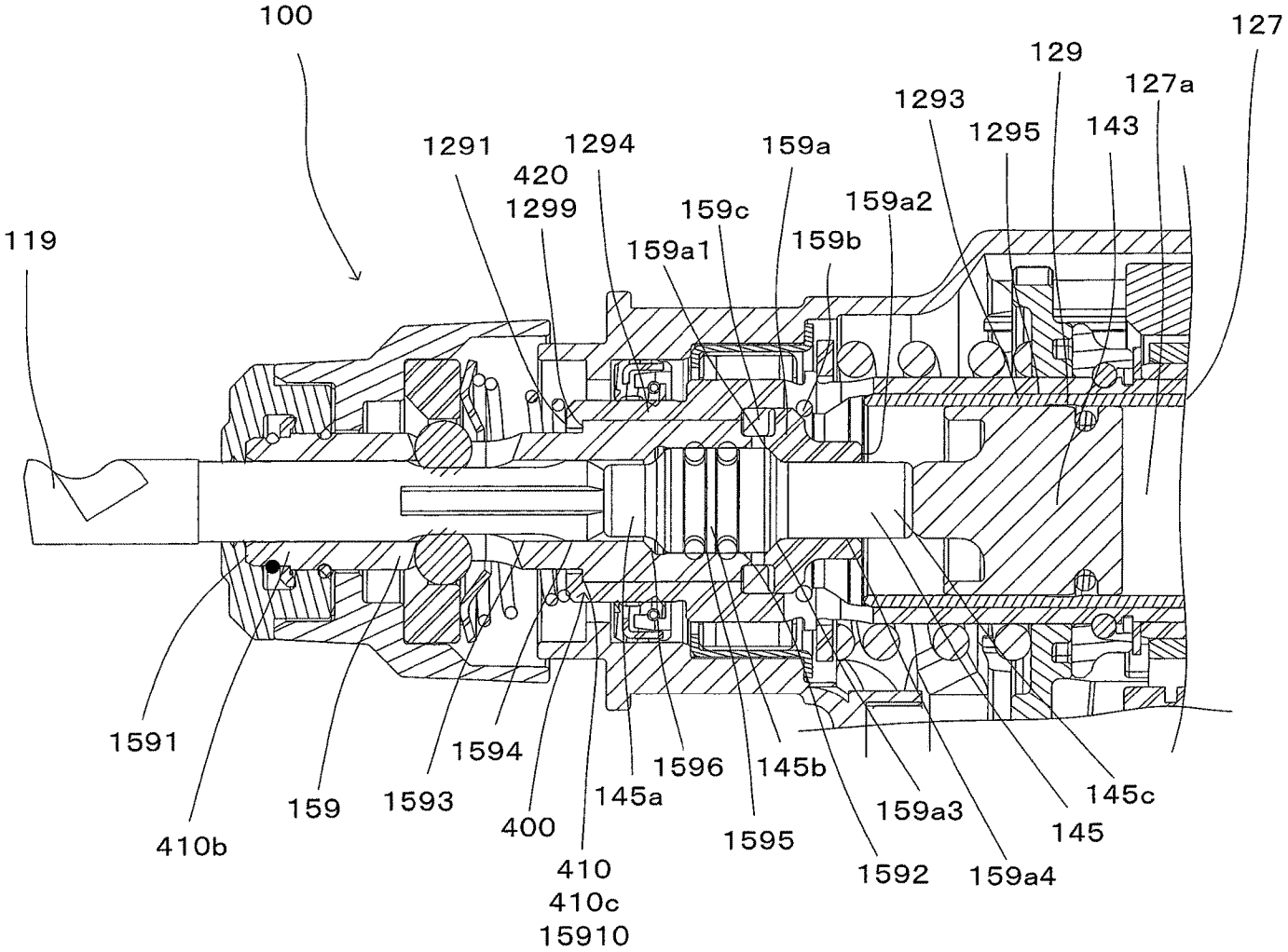
FIG. 14 is a view for showing a hammer drill according to a sixth embodiment of the present invention.

A hammer drill 100 according to a sixth embodiment of the present invention is now explained with reference to FIG. 14. The hammer drill 100 of the sixth embodiment is different from that of the third embodiment in the structure of the preventing mechanism 400.

Specifically, the restriction part 410 of the tool holder 159 is a wall surface 15910. The wall surface 15910 is formed by forming regions having different diameters in the outer periphery of a small-diameter part 1594. Thus, the small-diameter part 1594 has the first region 410*b* in its front region and the second region 410*c* in its rear region. The second region 410*c* protrudes from the first region 410*b* at the boundary between the first region 410*b* and the second region 410*c* and forms the wall surface 15910. Further, the stop part 420 of the cylinder 129 is a projection 1299. The projection 1299 is formed by protruding a peripheral edge of the front open end 1291 inward.

When the tool holder 159 is press-fitted into the cylinder 129, the wall surface 15910 comes into contact with the projection 1299. As a result, the tool holder 159 and the cylinder 129 are integrated together, and the tool holder 159 is prevented from further moving forward.

Like in the hammer drill 100 of the third embodiment, in the hammer drill 100 of the sixth embodiment, the tool holder 159 and the cylinder 129 can be separated from each other by moving the tool holder 159 rearward.

In the above-described embodiments, the handgrip 109 is formed in a cantilever form extending downward from the motor housing 103, but the form of the handgrip 109 should not be construed in a limiting sense. For example, the handgrip 109 may be formed in a loop shape such that the distal end of the handgrip 109 is further connected to the motor housing 103.

In the above-described embodiments, the output shaft 111 of the electric motor 110 is arranged to extend in parallel to the axis of the hammer bit 119, but the arrangement of the output shaft 111 should not be construed in a limiting sense. For example, the output shaft 111 of the electric motor 110 may be arranged to cross the axis of the hammer bit 119. In this case, it is preferred that the output shaft 111 and the intermediate shaft 116 are engaged with each other via a bevel gear. Further, it is preferred that the output shaft 111 is arranged perpendicularly to the axis of the hammer bit 119.

In the above-described embodiments, the pinion gear 113 and the driven gear 117 are formed as a helical gear, but the gear should not be construed in a limiting sense. For example, a gear such as a spur gear and a bevel gear may be used.

In view of the above, the impact tool according to this invention can be further provided with the following features. Each of the features can be used separately or in combination with the other, or in combination with the claimed invention.

(Further Aspect 1)

An impact tool, which is configured to perform a hammering operation on a workpiece by driving a tool accessory in a prescribed longitudinal direction, comprising:

a tool holder that holds the tool accessory such that the tool accessory protrudes from a front end of the tool holder, and a striking mechanism part that drives the tool accessory in the longitudinal direction, wherein:

a side of the front end of the tool holder in the longitudinal direction of the impact tool is defined as a front side, and a side opposite to the front side is defined as a rear side, the striking mechanism part includes a housing cylinder, a piston that is housed in the housing cylinder and caused to reciprocate in the longitudinal direction between the front side and the rear side, a striking element, and an air chamber that is defined between the piston and the striking element, the striking mechanism part being configured such that the striking element is driven by pressure fluctuations which are caused within the air chamber by the reciprocating movement of the piston and the tool accessory is driven in the longitudinal direction via a striking force of the striking element, the housing cylinder has a front open end on the front side and a rear open end on the rear side, the tool holder and the housing cylinder are integrated together when the tool holder is press-fitted into the housing cylinder up to a prescribed position from the rear open end toward the front open end, and further comprising a preventing mechanism, the preventing mechanism being configured to prevent the tool holder from further moving to the front side when the tool holder and the housing cylinder are integrated together.

(Further Aspect 2)

The impact tool as defined in further aspect 1, wherein the preventing mechanism comprises a fixed member separate from the tool holder and the housing cylinder.

(Further Aspect 3)

The impact tool as defined in further aspect 2, wherein the fixed member is arranged on an outer periphery of the tool holder.

(Further Aspect 4)

The impact tool as defined in further aspect 1, wherein:

the outer periphery of the tool holder has a first region and a second region protruding from the first region in a direction crossing the longitudinal direction, and the preventing mechanism comprises the second region.

(Further Aspect 5)

The impact tool as defined in any one of further aspects 1 to 4, wherein:

the tool holder and the housing cylinder which are integrated together are configured to be rotationally driven around the longitudinal direction, and the impact tool is capable of performing operation on the workpiece by rotation.

(Further Aspect 6)

The impact tool as defined in any one of further aspects 1 to 5, wherein:

the striking element is configured to reciprocatingly slide in the longitudinal direction between the front side and the rear side within the tool holder, and the tool holder has a sliding guide part that guides reciprocating slide of the striking element.

Correspondences Between the Features of the Embodiments and the Features of the Invention The above-described embodiments are representative examples for embodying the present invention, and the present invention is not limited to the constructions that have been described as the representative embodiments. Correspondences between the features of the embodiments and the features of the invention are as follow:

The hammer drill 100 is an example embodiment that corresponds to the "impact tool" according to the present invention. The hammer bit 119 is an example embodiment that corresponds to the "tool accessory" according to the present invention. The body housing 101 is an example embodiment that corresponds to the "body" according to the present invention. The central axis 100*a*, the extending axis 100*b* and the central plane 100*c* are example embodiments that correspond to the "central axis", the "extending axis" and the "prescribed plane", respectively, according to the present invention. The electric motor 110 is an example embodiment that corresponds to the "driving motor" according to the present invention. The first body element 101*a* and the holding member 130 are example embodiments that correspond to the "first body element", and the second body element 101*b* and the bearing support part 107 are example embodiments that correspond to the "second body element" according to the present invention. The striking mechanism 140 is an example embodiment that corresponds to the "striking mechanism" according to the present invention. The vibration reducing mechanism 200, the first guide shaft 170*a*, the first elastic member 210*a*, the second elastic member 210*b* and the weight part 220 are example embodiments that correspond to the "vibration reducing mechanism", the "guide part", the "first elastic member", the "second elastic member" and the "weight part", respectively, according to the present invention. The cushioning mechanism 300 is an example embodiment that corresponds to the "cushioning mechanism" according to the present invention.

DESCRIPTION OF THE NUMERALS

100 hammer drill (impact tool)
100*a* central axis
100*b* extending axis
100*c* central plane
101 body housing (body)
101*a* first body element
101*ad* arrow
101*b* second body element
103 motor housing
103*a* screw
103*b* baffle plate
105 gear housing
106 housing part
106*a* barrel part
107 bearing support part
107*a* guide receiving hole
107*b* guide receiving hole
108 guide support part
108*a* guide receiving hole
108*b* guide receiving hole
109 handgrip
109*a* trigger
109*b* power cable
110 electric motor
111 output shaft
112 fan
113 pinion gear
114 bearing
115 bearing
116 intermediate shaft
117 driven gear
118*a* bearing
118*b* bearing
119 hammer bit
119*d* arrow
120 motion converting mechanism
123 rotary body
123*a* bearing
124 coil spring
125 swinging shaft
126 joint pin
126*a* connecting element
127 piston
127*a* air chamber
129 cylinder
129*a* bearing
129*b* bearing
129*c* bearing case
130 holding member
130*a* wall surface
131 rotary body holding member
131*a* front part
131*a*1 guide insert hole
131*b* intermediate part
131*c* rear part
131*c*1 guide insert hole

132 cylinder holding part
132*a* guide insert hole
140 striking mechanism
143 striker
145 impact bolt
150 rotation transmitting mechanism
151 first gear
152 spline engagement part
153 second gear
159 tool holder
165 changeover dial
170*a* first guide shaft
170*b* second guide shaft
170*b*1 bearing
170*b*2 bearing
180 clutch mechanism
190 clutch sleeve
200 vibration reducing mechanism
210 elastic member
210*a* first elastic member
210*b* second elastic member
220 weight part
221 cylindrical part
222 connecting part
230 guide part
300 cushioning mechanism
301 first cushioning elastic member
302 second cushioning elastic member

The invention claimed is:

1. An impact tool configured to perform a hammering operation on a workpiece by driving a tool accessory in a prescribed longitudinal direction, the impact tool comprising:

a body including:

a first body element and a second body element connected via a cushioning mechanism, the first body element being configured to move with respect to the second body element; and a vibration reducing mechanism disposed on the first body element, the vibration reducing mechanism including:

a weight part disposed on a guide part, the weight part being configured to slide with respect to the guide part and between the first body element and the second body element, and an elastic member having a first elastic member disposed on a first body element side of the body and a second elastic member disposed on a second body element side of the body, the weight part being disposed between the first elastic member and the second elastic member; and a striking mechanism configured to drive the tool accessory in the longitudinal direction, the striking mechanism being disposed on the first body element.

2. The impact tool as defined in claim 1, further comprising a driving motor disposed on the second body element and configured to drive the striking mechanism.

3. The impact tool as defined in claim 1, further comprising:

a handgrip configured to be held by a user and having an extending axis intersecting a central axis of the tool accessory extending in the longitudinal direction, wherein a center of gravity of the weight part is located on a plane defined by the central axis and the extending axis.

4. The impact tool as defined in claim 3, wherein the weight part includes a plurality of weight elements.

5. The impact tool as defined in claim 1, wherein:

the first body element and the second body element are connected via the guide part, and the weight part and the elastic member are arranged coaxially with the guide part and are configured to reciprocatingly slide with respect to the guide part.

* * * * *